US009327297B2

(12) United States Patent
Walker

(10) Patent No.: US 9,327,297 B2
(45) Date of Patent: May 3, 2016

(54) ROTARY NOZZLE

(71) Applicant: Samuel C. Walker, Green Valley, AZ (US)

(72) Inventor: Samuel C. Walker, Green Valley, AZ (US)

(73) Assignee: Rain Bird Corporation, Azusa, CA (US)

( * ) Notice: Subject to any disclaimer, the term of this patent is extended or adjusted under 35 U.S.C. 154(b) by 162 days.

(21) Appl. No.: 13/828,582

(22) Filed: Mar. 14, 2013

(65) Prior Publication Data

US 2014/0027527 A1 Jan. 30, 2014

Related U.S. Application Data

(63) Continuation-in-part of application No. 13/560,423, filed on Jul. 27, 2012.

(51) Int. Cl.

| | |
|---|---|
| ***B05B 1/26*** | (2006.01) |
| ***B05B 3/00*** | (2006.01) |
| ***B05B 3/02*** | (2006.01) |
| ***B05B 3/04*** | (2006.01) |

(52) U.S. Cl.

CPC . *B05B 1/267* (2013.01); *B05B 1/26* (2013.01); *B05B 3/003* (2013.01); *B05B 3/021* (2013.01); *B05B 3/0486* (2013.01)

(58) Field of Classification Search

CPC ..... B05B 1/262; B05B 1/267; B05B 3/0486; B05B 1/3026

USPC ..... 239/520, 581.1, 581.2, DIG. 1, 242

See application file for complete search history.

(56) References Cited

U.S. PATENT DOCUMENTS

| | | | |
|---|---|---|---|
| 458,607 | A | 9/1891 | Weiss |
| 1,523,609 | A | 1/1922 | Roach |
| 1,432,386 | A | 10/1922 | Curney |
| 2,075,589 | A | 4/1933 | Munz |
| 2,125,863 | A | 4/1933 | Munz |
| 2,125,978 | A | 8/1938 | Arbogast |

(Continued)

FOREIGN PATENT DOCUMENTS

| | | |
|---|---|---|
| AU | 783999 | 1/2006 |
| CA | 2427450 | 6/2004 |

(Continued)

OTHER PUBLICATIONS

Mar. 29, 2011 Office Action, U.S. Appl. No. 12/475,242.

(Continued)

*Primary Examiner* — Len Tran
*Assistant Examiner* — Tuongminh Pham
(74) *Attorney, Agent, or Firm* — Fitch, Even, Tabin & Flannery, LLP

(57) ABSTRACT

A specialty nozzle is provided having a pattern adjusment valve that may be adjusted to irrigate a substantially rectangular irrigation area. The nozzle may be further adjusted to irrigate three different substantially rectangular irrigation areas. The nozzle functions as a three-in-one left strip nozzle, right strip nozzle, and side strip nozzle. The strip irrigation setting may be selected by pressing down and rotating a deflector to directly actuate the valve. The nozzle may also include a flow reduction valve to set the size of the rectangular irrigation areas and may be adjusted by actuation of an outer wall of the nozzle. Rotation of the outer wall causes a flow control member to move axially to or away from an inlet.

21 Claims, 23 Drawing Sheets

(56) References Cited

U.S. PATENT DOCUMENTS 2,128,552 A 8/1938 Arbogast
2,325,280 A 8/1938 Rader
2,130,810 A 9/1938 Munz
2,348,776 A 4/1941 Bentley
2,634,163 A 2/1948 Double
2,723,879 A 11/1955 Martin
2,785,013 A 3/1957 Stearns
2,875,783 A 3/1957 Schippers
2,935,266 A 6/1958 Coleondro et al.
2,914,257 A 1/1959 Wiant
2,990,123 A 6/1961 Hyde
2,990,128 A 6/1961 Hyde
3,029,030 A 4/1962 Dey
3,109,591 A 11/1963 Moen
3,239,149 A 3/1966 Lindberg, Jr.
3,380,659 A 4/1968 Seablom
3,752,403 A 8/1973 Diest
3,854,664 A 12/1974 Hunter
3,940,066 A 2/1976 Hunter
3,948,285 A 4/1976 Flynn
3,955,764 A 5/1976 Phaup
4,026,471 A 5/1977 Hunter
4,119,275 A 10/1978 Hunter
4,131,234 A 12/1978 Pescetto
4,189,099 A 2/1980 Bruninga
4,198,000 A 4/1980 Hunter
4,253,608 A 3/1981 Hunter
4,272,024 A 6/1981 Kah, Jr.
4,316,579 A 2/1982 Ray et al.
4,353,506 A 10/1982 Hayes
4,353,507 A 10/1982 Kah, Jr.
4,398,666 A 8/1983 Hunter
4,417,691 A 11/1983 Lockwood
4,456,181 A 6/1984 Burnham
4,471,908 A 9/1984 Hunter
4,479,611 A 10/1984 Galvis
4,501,391 A 2/1985 Hunter
4,566,632 A 1/1986 Sesser
4,568,024 A 2/1986 Hunter
4,579,284 A 4/1986 Arnold
4,579,285 A 4/1986 Hunter
4,609,146 A 9/1986 Walto
4,618,100 A 10/1986 White
4,624,412 A 11/1986 Hunter
4,625,917 A 12/1986 Torney
RE32,386 E 3/1987 Hunter
4,660,766 A 4/1987 Nelson et al.
4,669,663 A 6/1987 Meyer
4,676,438 A 6/1987 Sesser
4,681,260 A 7/1987 Cochran
4,681,263 A 7/1987 Cockman
4,682,732 A 7/1987 Walto
4,699,321 A 10/1987 Bivens et al.
4,708,291 A 11/1987 Grundy
4,718,605 A 1/1988 Hunter
4,720,045 A 1/1988 Meyer
4,739,934 A 4/1988 Gewelber
D296,464 S 6/1988 Marmol
4,752,031 A 6/1988 Merrick
4,763,838 A 8/1988 Holcomb
4,784,325 A 11/1988 Walker
4,796,809 A 1/1989 Hunter
4,796,811 A 1/1989 Davisson
4,815,662 A 3/1989 Hunter
4,834,289 A 5/1989 Hunter
4,836,449 A 6/1989 Hunter
4,836,450 A 6/1989 Hunter
4,840,312 A 6/1989 Tyler
4,842,201 A * 6/1989 Hunter ..... 239/396
4,867,378 A 9/1989 Kah, Jr.
4,898,332 A 2/1990 Hunter et al.
4,901,924 A 2/1990 Kah, Jr.
4,932,590 A 6/1990 Hunter
4,944,456 A 7/1990 Zakai
4,948,052 A 8/1990 Hunter
4,955,542 A 9/1990 Kah, Jr.
4,961,534 A 10/1990 Tyler et al.
4,967,961 A 11/1990 Hunter
4,971,250 A 11/1990 Hunter
D312,865 S 12/1990 Davisson
4,986,474 A 1/1991 Schisler et al.
5,031,840 A 7/1991 Grundy et al.
5,050,800 A 9/1991 Lamar
5,052,621 A 10/1991 Katzer et al.
5,058,806 A 10/1991 Rupar
5,078,321 A 1/1992 Davis
5,083,709 A 1/1992 Iwanowski
RE33,823 E 2/1992 Nelson
5,086,977 A 2/1992 Kah, Jr.
5,090,619 A 2/1992 Barthold
5,098,021 A 3/1992 Kah, Jr.
5,104,045 A 4/1992 Kah, Jr.
5,123,597 A 6/1992 Bendall
5,141,024 A 8/1992 Hicks
5,148,990 A 9/1992 Kah, Jr.
5,148,991 A 9/1992 Kah, Jr.
5,152,458 A 10/1992 Curtis
5,158,232 A 10/1992 Tyler et al.
5,174,501 A 12/1992 Hadar
5,199,646 A 4/1993 Kah, Jr.
5,205,491 A 4/1993 Hadar
5,224,653 A 7/1993 Nelson et al.
5,226,599 A 7/1993 Lindermeir et al.
5,226,602 A 7/1993 Cochran et al.
5,234,169 A 8/1993 McKenzie
5,240,182 A 8/1993 Lemme
5,240,184 A 8/1993 Lawson
5,267,689 A 12/1993 Forer
5,288,022 A 2/1994 Sesser
5,299,742 A 4/1994 Han
5,322,223 A 6/1994 Hadar
5,335,857 A 8/1994 Hagon
5,360,167 A 11/1994 Grundy et al.
5,370,311 A 12/1994 Chen
5,372,307 A 12/1994 Sesser
5,375,768 A 12/1994 Clark
5,398,872 A 3/1995 Joubran
5,417,370 A 5/1995 Kah, Jr.
5,423,486 A 6/1995 Hunter
5,435,490 A 7/1995 Machut
5,439,174 A 8/1995 Sweet
RE35,037 E 9/1995 Kah
5,456,411 A 10/1995 Scott et al.
5,503,139 A 4/1996 McMahon
5,526,982 A 6/1996 McKenzie
5,544,814 A 8/1996 Spenser
5,556,036 A 9/1996 Chase
5,588,594 A 12/1996 Kah, Jr.
5,588,595 A 12/1996 Sweet et al.
5,598,977 A 2/1997 Lemme
5,611,488 A 3/1997 Frolich
5,620,141 A 4/1997 Chiang
5,640,983 A 6/1997 Sherman
5,642,861 A 7/1997 Ogi et al.
5,653,390 A 8/1997 Kah, Jr.
5,662,545 A 9/1997 Zimmerman et al.
5,671,885 A 9/1997 Davisson
5,671,886 A 9/1997 Sesser
5,676,315 A 10/1997 Han
D388,502 S 12/1997 Kah, III
5,695,123 A 12/1997 Le
5,699,962 A 12/1997 Scott et al.
5,711,486 A 1/1998 Clark et al.
5,718,381 A * 2/1998 Katzer et al. ..... 239/222.11
5,720,435 A 2/1998 Hunter
5,722,593 A 3/1998 McKenzie
5,758,827 A 6/1998 Van Le et al.
5,762,270 A 6/1998 Kearby et al.
5,765,757 A 6/1998 Bendall
5,765,760 A 6/1998 Kuo
5,769,322 A 6/1998 Smith
5,785,248 A 7/1998 Staylor et al.
5,820,029 A 10/1998 Marans
5,823,439 A 10/1998 Hunter et al.

(56) References Cited

U.S. PATENT DOCUMENTS 5,823,440 A 10/1998 Clark
5,826,797 A 10/1998 Kah, III
5,845,849 A 12/1998 Mitzlaff
5,875,969 A 3/1999 Grundy
5,918,812 A 7/1999 Beutler
5,927,607 A 7/1999 Scott
5,971,297 A 10/1999 Sesser
5,988,523 A 11/1999 Scott
5,992,760 A 11/1999 Kearby et al.
6,007,001 A 12/1999 Hilton
6,019,295 A 2/2000 McKenzie
6,029,907 A 2/2000 McKenzie
6,042,021 A 3/2000 Clark
6,050,502 A 4/2000 Clark
6,076,744 A 6/2000 O'Brien
6,076,747 A 6/2000 Ming-Yuan
6,085,995 A 7/2000 Kah, Jr. et al.
6,102,308 A 8/2000 Steingrass
6,109,545 A 8/2000 Kah, Jr.
6,138,924 A 10/2000 Hunter et al.
6,145,758 A 11/2000 Ogi et al.
6,155,493 A 12/2000 Kearby
6,158,675 A 12/2000 Ogi
6,182,909 B1 2/2001 Kah, Jr. et al.
6,186,413 B1 2/2001 Lawson
6,223,999 B1 5/2001 Lemelshtrich
6,227,455 B1 5/2001 Scott et al.
6,230,988 B1 5/2001 Chao
6,230,989 B1 5/2001 Haverstraw
6,237,862 B1 5/2001 Kah, III et al.
6,241,158 B1 6/2001 Clark et al.
6,244,521 B1 6/2001 Sesser
6,264,117 B1 7/2001 Roman
6,286,767 B1 9/2001 Hui-Chen
6,332,581 B1 12/2001 Chin et al.
6,336,597 B1 1/2002 Kah, Jr.
6,341,733 B1 1/2002 Sweet
6,345,541 B1 2/2002 Hendey
6,367,708 B1 4/2002 Olson
D458,342 S 6/2002 Johnson
6,443,372 B1 9/2002 Hsu
6,454,186 B2 9/2002 Haverstraw
6,457,656 B1 10/2002 Scott
6,464,151 B1 10/2002 Cordua
6,478,237 B2 11/2002 Kearby
6,488,218 B1 12/2002 Townsend et al.
6,491,235 B1 12/2002 Scott et al.
6,494,384 B1 12/2002 Meyer
6,499,672 B1 12/2002 Sesser
6,530,531 B2 3/2003 Butler
6,601,781 B2 8/2003 Kah, III et al.
6,607,147 B2 8/2003 Schneider et al.
6,622,940 B2 9/2003 Huang
6,637,672 B2 10/2003 Cordua
6,651,904 B2 11/2003 Roman
6,651,905 B2 * 11/2003 Sesser et al. ..... 239/205
6,688,539 B2 2/2004 Vander Griend
6,695,223 B2 2/2004 Beutler et al.
6,715,699 B1 4/2004 Greenberg
6,719,218 B2 4/2004 Cool
6,732,952 B2 5/2004 Kah, Jr.
6,736,332 B2 5/2004 Sesser
6,736,336 B2 5/2004 Wong
6,769,633 B1 8/2004 Huang
6,814,304 B2 11/2004 Onofrio
6,814,305 B2 11/2004 Townsend
6,817,543 B2 11/2004 Clark
6,820,825 B1 11/2004 Wang
6,827,291 B2 12/2004 Townsend
6,834,816 B2 12/2004 Kah, Jr.
6,840,460 B2 1/2005 Clark
6,848,632 B2 2/2005 Clark
6,854,664 B2 2/2005 Smith
6,869,026 B2 3/2005 McKenzie et al.
6,871,795 B2 3/2005 Anuskiewicz
6,880,768 B2 4/2005 Lau
6,883,727 B2 4/2005 De Los Santos
6,921,030 B2 7/2005 Renquist
6,942,164 B2 9/2005 Walker
6,945,471 B2 9/2005 McKenzie et al.
6,957,782 B2 10/2005 Clark et al.
6,997,393 B1 2/2006 Angold et al.
7,017,831 B2 3/2006 Santiago et al.
7,017,837 B2 3/2006 Taketomi
7,028,920 B2 4/2006 Hekman et al.
7,028,927 B2 4/2006 Mermet
7,032,836 B2 4/2006 Sesser et al.
7,032,844 B2 4/2006 Cordua
7,040,553 B2 5/2006 Clark
7,044,403 B2 5/2006 Kah, III et al.
7,070,122 B2 7/2006 Burcham
7,090,146 B1 8/2006 Ericksen et al.
7,100,842 B2 9/2006 Meyer et al.
7,104,472 B2 9/2006 Renquist
7,111,795 B2 9/2006 Thong
7,143,957 B2 12/2006 Nelson
7,143,962 B2 12/2006 Kah, Jr.
7,152,814 B1 12/2006 Schapper
7,156,322 B1 1/2007 Heitzman
7,159,795 B2 1/2007 Sesser et al.
7,168,634 B2 1/2007 Onofrio
7,232,081 B2 6/2007 Kah, Jr. et al.
7,234,651 B2 6/2007 Mousavi et al.
7,240,860 B2 7/2007 Griend
7,287,711 B2 10/2007 Crooks
7,293,721 B2 11/2007 Roberts
7,303,147 B1 12/2007 Danner et al.
7,303,153 B2 12/2007 Han et al.
7,322,533 B2 1/2008 Grizzle
7,337,988 B2 3/2008 McCormick
7,389,942 B2 6/2008 Kenyon et al.
RE40,440 E 7/2008 Sesser
7,392,956 B2 7/2008 McKenzie
7,429,005 B2 * 9/2008 Schapper et al. ..... 239/520
7,478,526 B2 1/2009 McAfee
7,533,833 B2 5/2009 Wang
7,581,687 B2 9/2009 Feith
7,584,906 B2 9/2009 Lev
7,597,273 B2 10/2009 McAfee
7,607,588 B2 10/2009 Nobili
7,611,077 B2 * 11/2009 Sesser ..... B05B 3/0486 239/222.11
7,621,467 B1 11/2009 Garcia
7,654,474 B2 2/2010 Cordua
7,686,235 B2 3/2010 Roberts
7,686,236 B2 3/2010 Alexander
7,703,706 B2 4/2010 Walker
D615,152 S 5/2010 Kah et al.
7,766,259 B2 8/2010 Feith
D628,272 S 11/2010 Kah et al.
7,828,229 B2 11/2010 Kah
7,850,094 B2 12/2010 Richmond et al.
7,861,948 B1 1/2011 Crooks
D636,459 S 4/2011 Kah et al.
7,926,746 B2 4/2011 Melton
7,971,804 B2 7/2011 Roberts
RE42,596 E 8/2011 Sesser
8,006,919 B2 8/2011 Renquist et al.
8,047,456 B2 11/2011 Kah et al.
8,056,829 B2 11/2011 Gregory
8,074,897 B2 12/2011 Hunnicutt et al.
8,205,811 B2 6/2012 Cordua
8,272,583 B2 9/2012 Hunnicutt et al.
2001/0023901 A1 9/2001 Haverstraw
2002/0070289 A1 6/2002 Hsu
2002/0130202 A1 9/2002 Kah, Jr. et al.
2002/0153434 A1 10/2002 Cordua
2003/0006304 A1 1/2003 Cool
2003/0015606 A1 1/2003 Cordua
2003/0042327 A1 3/2003 Beutler
2003/0071140 A1 4/2003 Roman
2003/0075620 A1 4/2003 Kah
2004/0108391 A1 6/2004 Onofrio
2005/0006501 A1 1/2005 Englefield

(56) References Cited

U.S. PATENT DOCUMENTS

| | | | | |
|---|---|---|---|---|
| 2005/0161534 | A1 | 7/2005 | Kah | |
| 2005/0194464 | A1 | 9/2005 | Bruninga | |
| 2005/0194479 | A1 | 9/2005 | Curtis | |
| 2006/0038046 | A1 | 2/2006 | Curtis | |
| 2006/0086832 | A1 | 4/2006 | Roberts | |
| 2006/0086833 | A1 | 4/2006 | Roberts | |
| 2006/0108445 | A1 | 5/2006 | Pinch | |
| 2006/0144968 | A1 | 7/2006 | Lev | |
| 2006/0237198 | A1 | 10/2006 | Crampton | |
| 2006/0273202 | A1 | 12/2006 | Su | |
| 2006/0281375 | A1 | 12/2006 | Jordan | |
| 2007/0012800 | A1 | 1/2007 | McAfee | |
| 2007/0034711 | A1 | 2/2007 | Kah, Jr. | |
| 2007/0034712 | A1 | 2/2007 | Kah, Jr. | |
| 2007/0119975 | A1* | 5/2007 | Hunnicutt | 239/200 |
| 2007/0181711 | A1 | 8/2007 | Sesser | |
| 2007/0235565 | A1 | 10/2007 | Kah, Jr. et al. | |
| 2007/0246567 | A1 | 10/2007 | Roberts | |
| 2008/0169363 | A1 | 7/2008 | Walker | |
| 2008/0217427 | A1 | 9/2008 | Wang | |
| 2008/0257982 | A1 | 10/2008 | Kah | |
| 2008/0276391 | A1 | 11/2008 | Jung | |
| 2008/0277499 | A1 | 11/2008 | McAfee | |
| 2009/0008484 | A1 | 1/2009 | Feith | |
| 2009/0014559 | A1 | 1/2009 | Marino | |
| 2009/0072048 | A1 | 3/2009 | Renquist | |
| 2009/0078788 | A1 | 3/2009 | Holmes | |
| 2009/0108099 | A1 | 4/2009 | Porter | |
| 2009/0140076 | A1 | 6/2009 | Cordua | |
| 2009/0173803 | A1 | 7/2009 | Kah, Jr. et al. | |
| 2009/0173904 | A1 | 7/2009 | Roberts | |
| 2009/0188988 | A1 | 7/2009 | Walker | |
| 2009/0224070 | A1 | 9/2009 | Clark et al. | |
| 2010/0090024 | A1 | 4/2010 | Hunnicutt | |
| 2010/0108787 | A1 | 5/2010 | Walker | |
| 2010/0176217 | A1 | 7/2010 | Richmond | |
| 2010/0257670 | A1 | 10/2010 | Hodel | |
| 2010/0276512 | A1 | 11/2010 | Nies | |
| 2010/0301135 | A1 | 12/2010 | Hunnicutt et al. | |
| 2010/0301142 | A1 | 12/2010 | Hunnicutt et al. | |
| 2011/0024522 | A1 | 2/2011 | Anuskiewicz | |
| 2011/0024526 | A1 | 2/2011 | Feith | |
| 2011/0089250 | A1 | 4/2011 | Zhao et al. | |
| 2011/0121097 | A1 | 5/2011 | Walker | |
| 2011/0147484 | A1 | 6/2011 | Walker | |
| 2011/0248093 | A1 | 10/2011 | Kim | |
| 2011/0248094 | A1 | 10/2011 | Robertson | |
| 2011/0248097 | A1 | 10/2011 | Kim | |
| 2011/0309161 | A1 | 12/2011 | Renquist | |
| 2012/0012670 | A1 | 1/2012 | Kah, Jr. et al. | |
| 2012/0061489 | A1 | 3/2012 | Hunnicutt et al. | |
| 2012/0153051 | A1 | 6/2012 | Kah, Jr. et al. | |
| 2012/0292403 | A1 | 11/2012 | Hunnicutt et al. | |
| 2013/0334332 | A1 | 12/2013 | Robertson et al. | |
| 2013/0334340 | A1 | 12/2013 | Robertson | |
| 2014/0027526 | A1 | 1/2014 | Shadbolt et al. | |
| 2014/0027527 | A1 | 1/2014 | Shadbolt | |

FOREIGN PATENT DOCUMENTS

| | | | |
|---|---|---|---|
| CN | 2794646 | | 7/2006 |
| CN | 2805823 | | 8/2006 |
| DE | 1283591 | B | 11/1968 |
| DE | 3335805 | A1 | 2/1985 |
| EP | 463742 | | 1/1992 |
| EP | 489679 | | 6/1992 |
| EP | 518579 | | 12/1992 |
| EP | 572747 | | 12/1993 |
| EP | 646417 | | 4/1995 |
| EP | 0724913 | A2 | 8/1996 |
| EP | 0761312 | A1 | 12/1997 |
| EP | 1016463 | | 7/2000 |
| EP | 1043077 | | 10/2000 |
| EP | 1043075 | A1 | 11/2000 |
| EP | 1173286 | | 1/2002 |
| EP | 1250958 | | 10/2002 |
| EP | 1270082 | | 1/2003 |
| EP | 1289673 | | 3/2003 |
| EP | 1426112 | | 6/2004 |
| EP | 1440735 | | 7/2004 |
| EP | 1452234 | | 9/2004 |
| EP | 1502660 | | 2/2005 |
| EP | 1508378 | | 2/2005 |
| EP | 1818104 | | 8/2007 |
| EP | 1944090 | | 7/2008 |
| EP | 2251090 | A2 | 11/2010 |
| EP | 2255884 | A1 | 12/2010 |
| GB | 1234723 | | 6/1971 |
| GB | 2330783 | | 5/1999 |
| SU | 923635 | A | 4/1982 |
| WO | 9520988 | | 8/1995 |
| WO | 9727951 | | 8/1997 |
| WO | 9735668 | | 10/1997 |
| WO | 0007428 | | 12/2000 |
| WO | 0131996 | | 5/2001 |
| WO | 0162395 | | 8/2001 |
| WO | 02078857 | | 10/2002 |
| WO | 02098570 | | 12/2002 |
| WO | 03086643 | | 10/2003 |
| WO | 2004052721 | | 6/2004 |
| WO | 2005099905 | | 10/2005 |
| WO | 2005115554 | | 12/2005 |
| WO | 2005123263 | | 12/2005 |
| WO | 2006108298 | | 10/2006 |
| WO | 2007131270 | | 11/2007 |
| WO | 2008130393 | | 10/2008 |
| WO | 2009036382 | | 3/2009 |
| WO | 2010036241 | | 4/2010 |
| WO | 2010126769 | | 11/2010 |
| WO | 2011075690 | | 6/2011 |

OTHER PUBLICATIONS

Aug. 5, 2010 EPO Search Report and Opinion, EPO Application No. 10164085.2.

Advisory Action mailed Jul. 14, 2011 in U.S. Appl. No. 11/947,571.

Interview Summary mailed Sep. 26, 2011 in U.S. Appl. No. 12/475,242.

Office Action mailed Apr. 5, 2011 in U.S. Appl. No. 11/947,571.

Office Action mailed Jul. 20, 2011 in U.S. Appl. No. 12/475,242.

Office Action mailed Aug. 24, 2010 in U.S. Appl. No. 11/947,571.

Response to Office Action filed Apr. 29, 2011 in U.S. Appl. No. 12/475,242.

Response to Office Action filed Jul. 5, 2011 in U.S. Appl. No. 11/947,571.

Response to Office Action filed Oct. 18, 2011 in U.S. Appl. No. 12/475,242.

Response to Office Action filed Nov. 24, 2010 in U.S. Appl. No. 11/947,571.

Office action dated Sep. 3, 2013 for U.S. Appl. No. 13/300,946.

Office Action for U.S. Appl. No. 13/562,825, mailed on Oct. 15, 2012.

U.S. Appl. No. 13/560,423, filed Jul. 27, 2012.

U.S. Appl. No. 12/686,895, filed Jan. 13, 2010.

United States Patent and Trademark Office, Dec. 4, 2012 Office Action in U.S. Appl. No. 12/686,895.

United States Patent and Trademark Office, Apr. 10, 2013 Office Action in U.S. Appl. No. 13/562,825.

United States Patent and Trademark Office, May 24, 2013 Office Action in U.S. Appl. No. 12/720,261.

U.S. Appl. No. 13/828,582, filed Mar. 14, 2013.

U.S. Appl. No. 61/681,798, filed Aug. 10, 2012.

U.S. Appl. No. 61/681,802, filed Aug. 10, 2012.

Jan. 5, 2011 Office Action, U.S. Appl. No. 12/248,644.

Sep. 30, 2010 Office Action, U.S. Appl. No. 12/248,644.

Jun. 25, 2012 Response to Office Action, U.S. Appl. No. 13/300,946.

Office Action for U.S. Appl. No. 13/300,946, mailed on Jun. 7, 2012.

Office Action for U.S. Appl. No. 13/300,946, mailed on Oct. 12, 2012.

U.S. Appl. No. 12/757,912, filed Apr. 19, 2010.

(56) References Cited

OTHER PUBLICATIONS

U.S. Appl. No. 12/859,159, filed Aug. 18, 2010.
U.S. Appl. No. 13/069,334, filed Mar. 22, 2011.
U.S. Appl. No. 13/523,846, filed Jun. 14, 2012.
USPTO Office Action in U.S Appl. No. 13/300,946, Mailed Jun. 7, 2012.
USPTO Office Action in U.S. Appl. No. 13/300,946, Mailed Oct. 12, 2012.
USPTO Office Action in U.S. Appl. No. 13/562,825, Mailed Oct. 15, 2012.
U.S. Appl. No. 12/248,644, filed Oct. 9, 2008.
U.S. Appl. No. 13/300,946, filed Nov. 21, 2011.
U.S. Appl. No. 12/475,242, filed May 29, 2009.
U.S. Appl. No. 12/720,261, filed Mar. 9, 2010.
U.S. Appl. No. 12/952,309, filed Nov. 23, 2010.
U.S. Appl. No. 13/495,402, filed Jun. 13, 2012.
U.S. Appl. No. 13/562,825, filed Jul. 31, 2012.
International Search Report for Application No. PCT/US2013/052330 dated Nov. 7, 2013.
Applicant-Initiated Interview Summary and Final Office Action mailed Mar. 5, 2014 for U.S. Appl. No. 12/972,271 (12 pgs.).
Final Office Action mailed Dec. 5, 2013 for U.S. Appl. No. 12/972,271 (9 pgs.).
Non-Final Office Action dated Dec. 16, 2014 for U.S. Appl. No. 13/560,423 (18 pgs.).
Non-Final Office Action dated Jan. 10, 2014 for U.S. Appl. No. 13/069,334 (6 pgs.).
Non-Final Office Action mailed Jun. 5, 2013 for U.S. Appl. No. 12/972,271 (8 pgs.).
Response dated Apr. 10, 2015 to Office Action mailed Dec. 16, 2014 for U.S. Appl. No. 13/560,423 (21 pgs.).
Response dated Feb. 10, 2014 to Office Action mailed Jan. 10, 2014 for U.S. Appl. No. 13/069,334 (3 pgs.).
Response dated Jul. 25, 2012 to Non-Final Office Action Apr. 25, 2012 for U.S. Appl. No. 12/757,912 (27 pgs.).
Response dated Mar. 25, 2013 to Final Rejection dated Oct. 23, 2012 for U.S. Appl. No. 12/757,912.
Response dated Sep. 16, 2013 to Office Action mailed Jun. 5, 2013 for U.S. Appl. No. 12/972,271 (15 pgs.).
USPTO Applicant-Initiated Interview Summary dated Apr. 23, 2013 for U.S. Appl. No. 12/757,912 (3 pgs.).
USPTO Final Rejection dated Oct. 23, 2012 for U.S. Appl. No. 12/757,912 (19 pgs.).
USPTO Non-Final Office Action dated Apr. 25, 2012 for U.S. Appl. No. 12/757,912 (17 pgs.).
Written Opinion of the International Searching Authority and International Search Report issued in International Patent Application No. PCT/US10/61132 on Apr. 19, 2011.
Non-Final Office Action mail Nov. 5, 2014 for U.S. Appl. No. 13/495,402.
U.S. Appl. No. 13/495,402; Notice of Allowance mailed Mar. 6, 2015.
Response dated Feb. 4, 2015 to Office Action mailed Nov. 5, 2014 for U.S. Appl. No. 13/495,402 (16 pgs.).
Notice of Allowance and Fees Due for U.S. Appl. No. 13/560,423 dated Nov. 12, 2015.

* cited by examiner

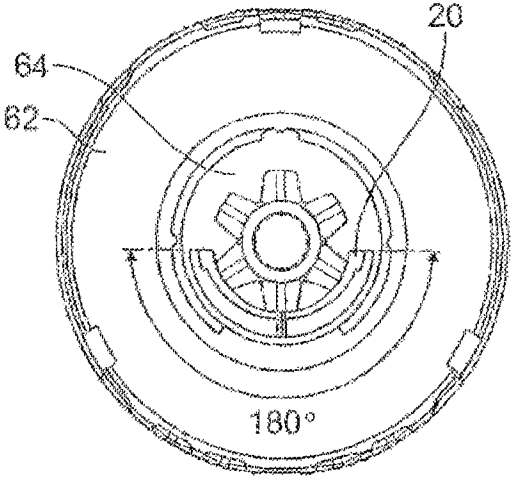
FIG. 7A
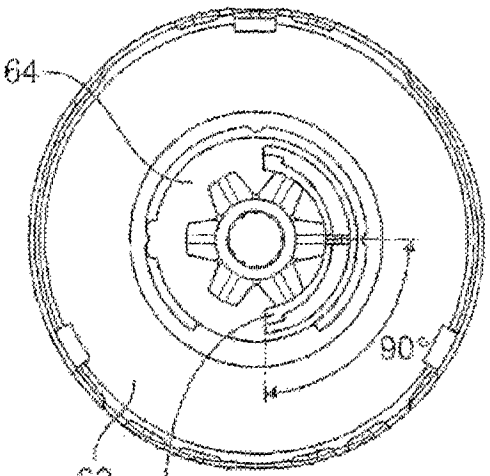
FIG. 7B
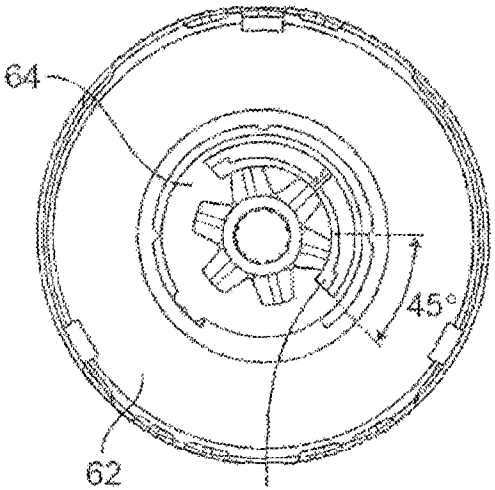
FIG. 7C
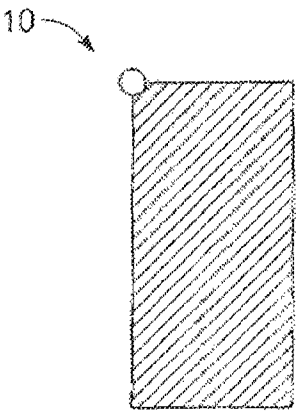
FIG. 7D
FIG. 7E
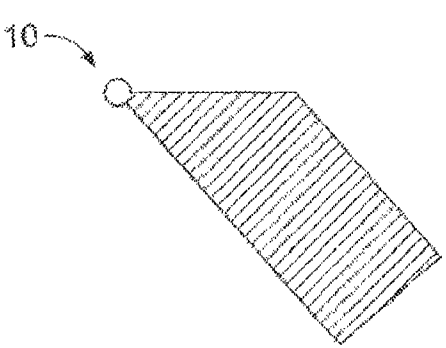
FIG. 7F

ROTARY NOZZLE

CROSS-REFERENCE TO RELATED APPLICATION

This application is a continuation-in-part application of pending U.S. patent application Ser. No. 13/560,423, filed Jul. 27, 2012, which is incorporated by reference herein in its entirety.

FIELD

The invention relates to irrigation nozzles and, more particularly, to an irrigation rotary nozzle for distribution of water with an adjustable radius of throw.

BACKGROUND

Nozzles are commonly used for the irrigation of landscape and vegetation. In a typical irrigation system, various types of nozzles are used to distribute water over a desired area, including rotating stream type and fixed spray pattern type nozzles. One type of irrigation nozzle is the rotating deflector or so-called micro-stream type having a rotatable vaned deflector for producing a plurality of relatively small water streams swept over a surrounding terrain area to irrigate adjacent vegetation.

Rotating stream nozzles of the type having a rotatable vaned deflector for producing a plurality of relatively small outwardly projected water streams are known in the art. In such nozzles, water is directed upwardly against a rotatable deflector having a vaned lower surface defining an array of relatively small flow channels extending upwardly and turning radially outwardly with a spiral component of direction. The water impinges upon this underside surface of the deflector to fill these curved channels and to rotatably drive the deflector. At the same time, the water is guided by the curved channels for projection outwardly from the nozzle in the form of a plurality of relatively small water streams to irrigate a surrounding area. As the deflector is rotatably driven by the impinging water, the water streams are swept over the surrounding terrain area, with the range of throw depending on the amount of water through the nozzle, among other things.

In rotating stream nozzles and in other nozzles, it is desirable to control the arcuate area through which the nozzle distributes water. In this regard, it is desirable to use a nozzle that distributes water through a variable pattern, such as a full circle, half-circle, or some other arc portion of a circle, at the discretion of the user. Traditional variable arc nozzles suffer from limitations with respect to setting the water distribution arc. Some have used interchangeable pattern inserts to select from a limited number of water distribution arcs, such as quarter-circle or half-circle. Others have used punch-outs to select a fixed water distribution arc, but once a distribution arc was set by removing some of the punch-outs, the arc could not later be reduced. Many conventional nozzles have a fixed, dedicated construction that permits only a discrete number of arc patterns and prevents them from being adjusted to any arc pattern desired by the user.

Other conventional nozzle types allow a variable arc of coverage but only for a very limited arcuate range. Because of the limited adjustability of the water distribution arc, use of such conventional nozzles may result in overwatering or underwatering of surrounding terrain. This is especially true where multiple nozzles are used in a predetermined pattern to provide irrigation coverage over extended terrain. In such instances, given the limited flexibility in the types of water distribution arcs available, the use of multiple conventional nozzles often results in an overlap in the water distribution arcs or in insufficient coverage. Thus, certain portions of the terrain are overwatered, while other portions may not even be watered at all. Accordingly, there is a need for a variable arc nozzle that allows a user to set the water distribution arc along a substantial continuum of arcuate coverage, rather than several models that provide a limited arcuate range of coverage.

In many applications, it also is desirable to be able to set the nozzle for irrigating a rectangular area of the terrain. Specialty nozzles have been developed for irrigating terrain having specific geometries, such as rectangular strips, and these specialty nozzles include left strip, right strip, and side strip nozzles. Frequently, however, a user must use a different specialty nozzle for each different type of pattern, i.e., a left strip versus a right strip nozzle. It would be desirable to have one nozzle that can be adjusted to accommodate each of these different geometries.

It is also desirable to control or regulate the throw radius of the water distributed to the surrounding terrain. In this regard, in the absence of a radius adjustment device, the irrigation nozzle will have limited variability in the throw radius of water distributed from the nozzle. The inability to adjust the throw radius results both in the wasteful and insufficient watering of terrain. A radius adjustment device is desired to provide flexibility in water distribution through varying radius pattern, and without varying the water pressure from the source. Some designs provide only limited adjustability and, therefore, allow only a limited range over which water may be distributed by the nozzle.

Accordingly, a need exists for a variable arc nozzle that can be adjusted to a substantial range of water distribution arcs. Further, there is a need for a specialty nozzle that provides strip irrigation of different geometries and eliminates the need for multiple models. In addition, a need exists to increase the adjustability of the throw radius of an irrigation nozzle without varying the water pressure, particularly for rotating stream nozzles providing a plurality of relatively small water streams over a surrounding terrain area.

BRIEF DESCRIPTION OF THE DRAWINGS

FIGS. 7A-C are top plan views of the assembled valve sleeve and nozzle housing of the nozzle of FIG. 1 in a side strip (180 degree), left strip (90 degree) and left corner (45 degree) configuration, respectively;

FIGS. 7D-F are representational views of the irrigation patterns and coverage areas of the side strip (180 degree), left strip (90 degree) and left corner (45 degree) configuration, respectively;

DESCRIPTION OF THE PREFERRED EMBODIMENTS

Figure 1:
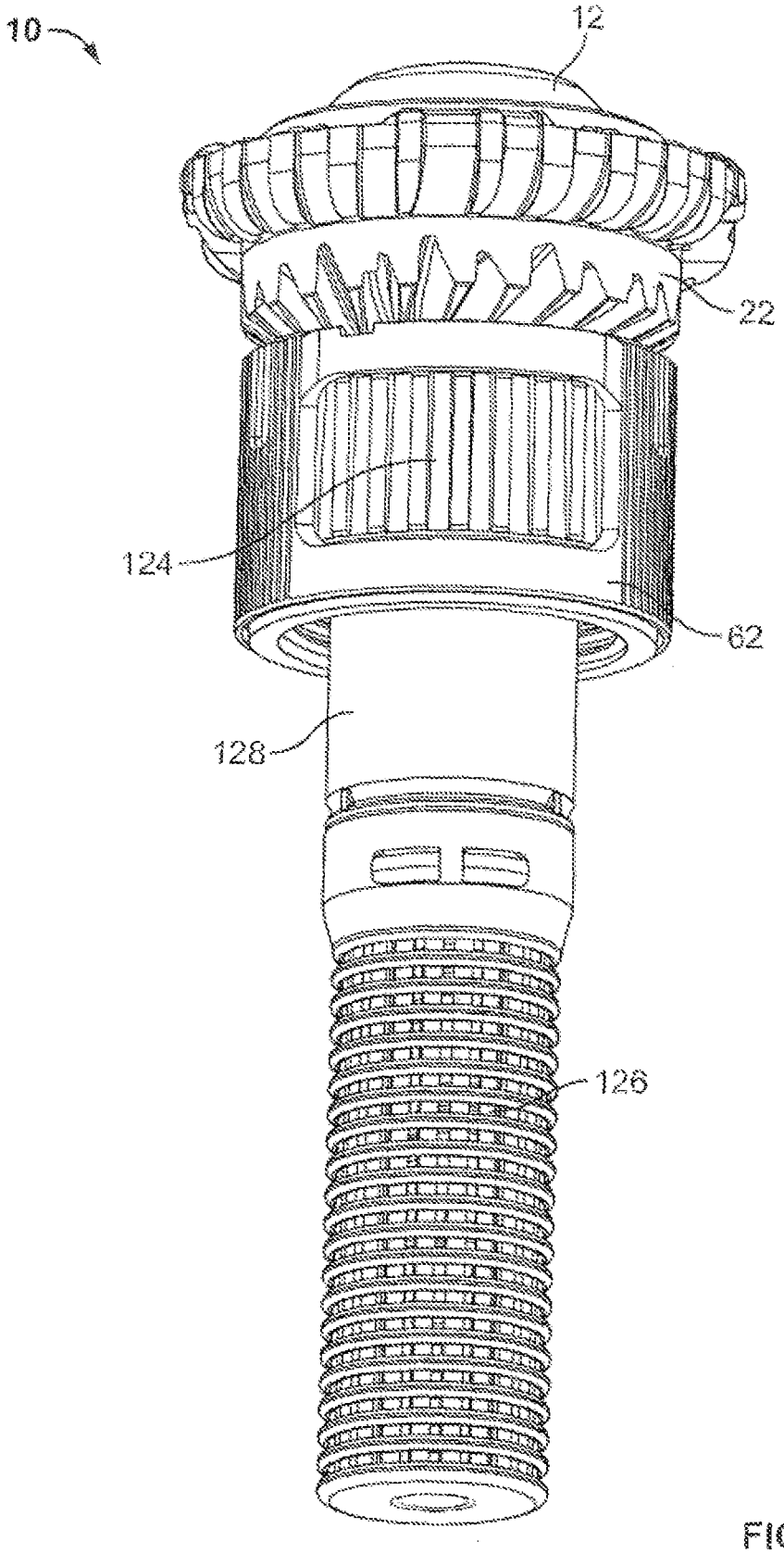
FIG. 1 is a perspective view of an embodiment of a nozzle embodying features of the pretend invention.

FIGS. 1-4 show a sprinkler head or nozzle 10 that possesses an arc adjustability capability that allows a user to generally set the arc or pattern of water distribution to a desired angle. The arc/pattern adjustment feature does not require a hand tool to access a slot at the top of the nozzle 10 to rotate a shaft. Instead, the user may depress part or all of the deflector 22 and rotate the deflector 22 to directly set an arc adjustment (or pattern adjustment) valve 14. The nozzle 10 also preferably includes a radius adjustment feature, which is shown in FIGS. 1-4, to change the throw radius. The radius adjustment feature is accessible by rotating an outer wall portion of the nozzle 10, as described further below.

Some of the structural components of the nozzle 10 are similar to those described in U.S. patent application Ser. Nos. 12/952,369 and 13/495,402, which are assigned to the assignee of the present application and which applications are incorporated herein by reference in their entirely. Also, some of the user operation of arc and radius adjustment is similar to that described in these two applications. Differences are addressed below and can be seen with reference to the figures.

As described in more detail below, the nozzle 10 allows a user to depress and rotate the deflector 22 to directly actuate the arc adjustment valve 14, i.e., to adjust the arc setting of the valve. The deflector 22 directly engages and rotates one of the two nozzle body portions that form the valve 14 (valve sleeve or pattern plate 64). The valve 14 preferably operates through the use of two valve bodies to define an arcuate opening 20. Although the nozzle 10 preferably includes a shaft 34, the user does not need to use a hand tool to effect rotation of the shaft 34 to adjust the arc adjustment valve 14. The shaft 34 is not rotated to adjust the valve 14. Indeed, in certain forms, the shaft 34 may be fixed against rotation, such as though use of splined engagement surfaces.

As can be seen in FIGS. 1-4, the nozzle 10 generally comprises a compact unit, preferably made primarily of lightweight molded plastic, which is adapted for convenient thread-on mounting onto the upper end of a stationary or pop-up riser (not shown). In operation, water under pressure is delivered through the riser to a nozzle body 16. The water preferably passes through an inlet 134 controlled by a radius adjustment feature that regulates the amount of fluid flow through the nozzle body 16. The water is then directed through an arcuate opening 20 that is generally adjustable between about 45 and 180 degrees and controls the arcuate span of water distributed form the nozzle 10. Water is directed generally upwardly through the arcuate opening 20 to produce one or more upwardly directed water jets that impinge the underside surface of a deflector 22 for rotatably driving the deflector 22.

Figure 4A:
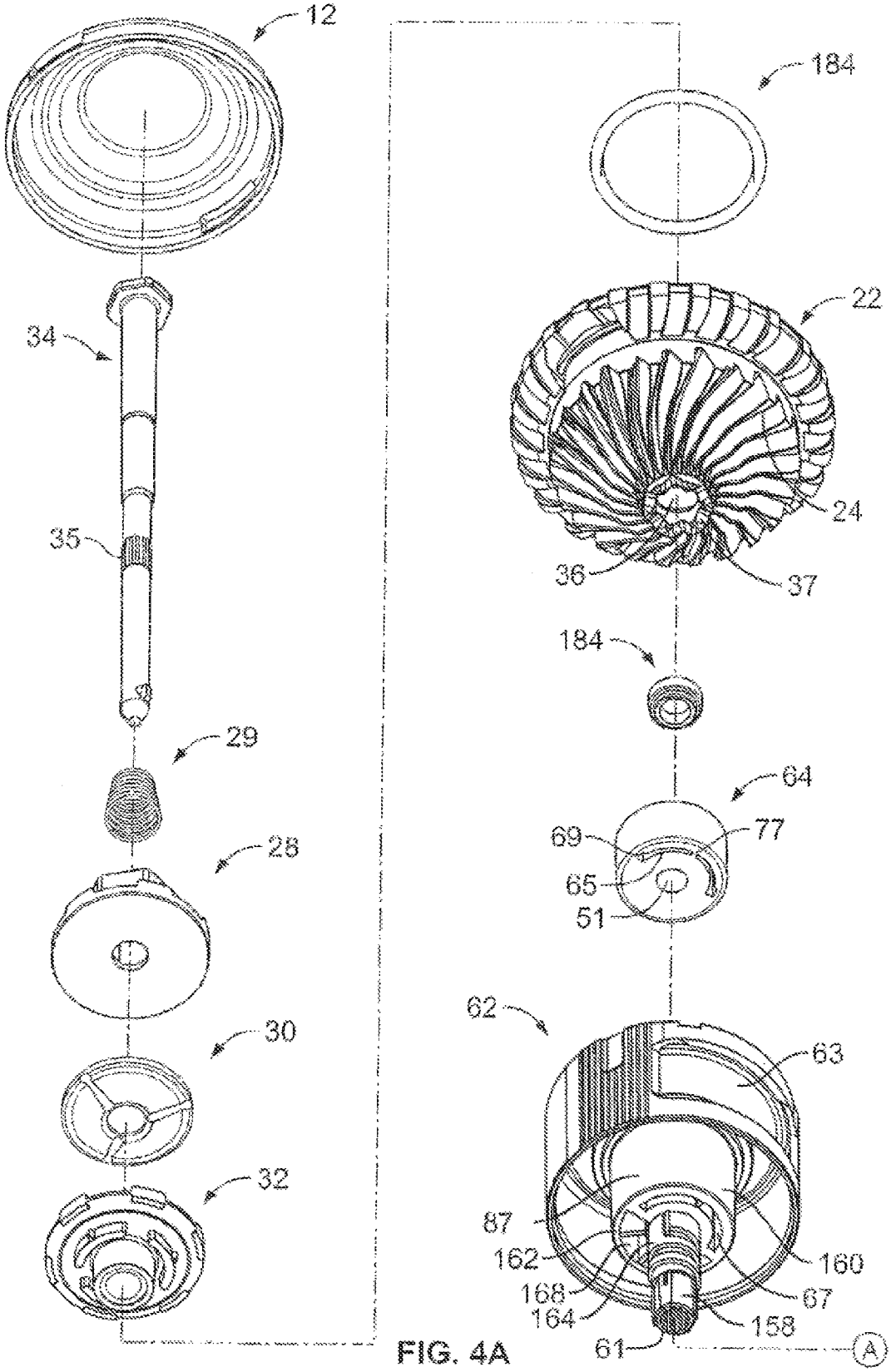
FIGS. 4A and 4B are bottom exploded perspective views of the nozzle of FIG. 1.
Figure 4B:
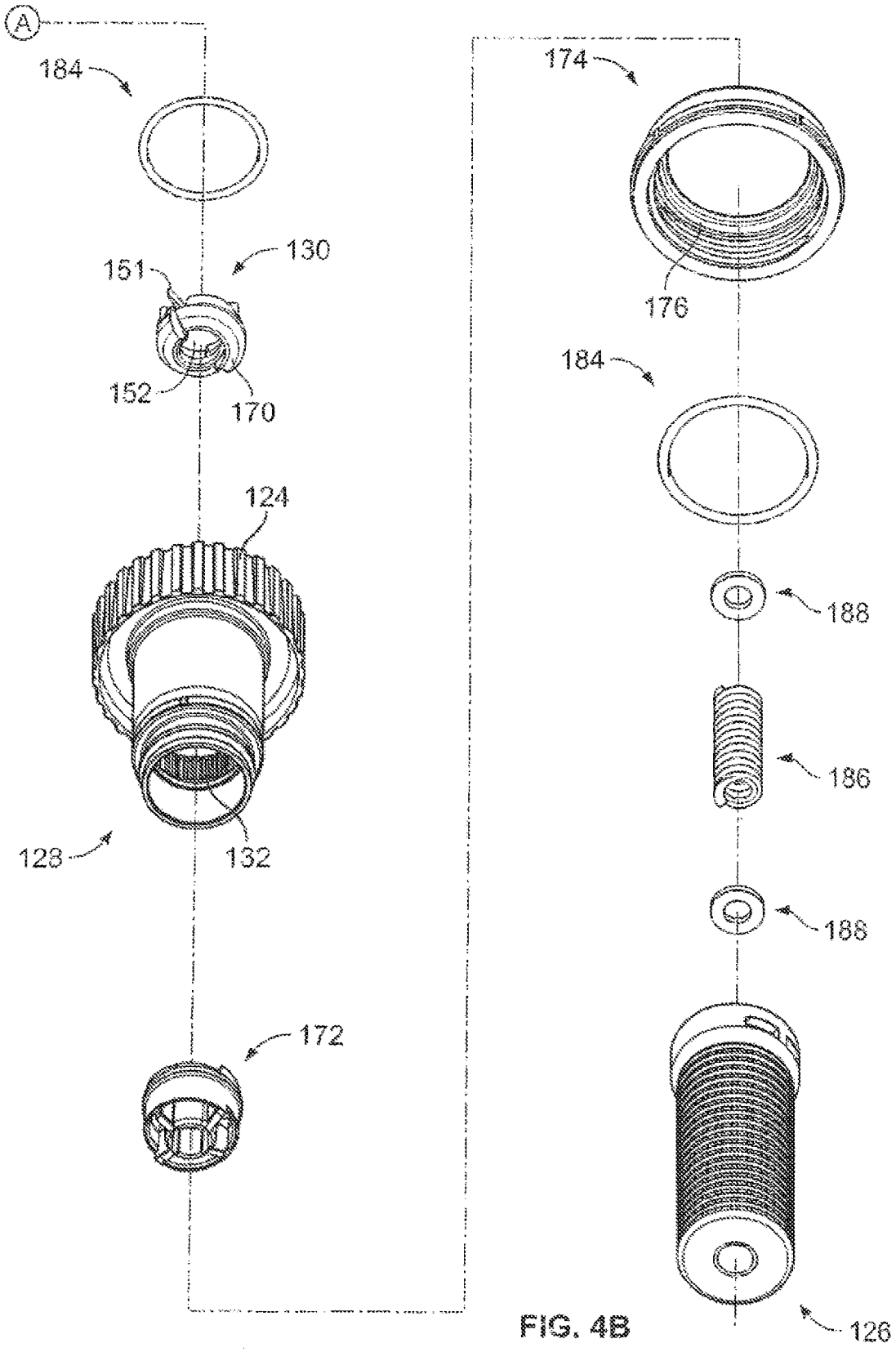

The rotatable deflector 22 has an underside surface that is preferably contoured to deliver a plurality of fluid streams generally radially outwardly through an arcuate span. As shown in FIG. 4, the underside surface of the deflector 22 preferably includes an array of spiral vanes 24. The spiral vanes 24 subdivide the water into the plurality of relatively small water streams which are distributed radially outwardly to surrounding terrain as the deflector 22 rotates. The vanes 24 define a plurality of intervening flow channels extending upwardly and spiraling along the underside surface to extend generally radially outwardly with selected inclination angles. During operation of the nozzle 10, the upwardly directed water impinges upon the lower or upstream segments of these vanes 24, which subdivide the water flow into the plurality of relatively small flow streams for passage though the flow channels and radially outward projection from the nozzle 10. A deflector like the type shown in U.S. Pat. No. 6,814,304, which is assigned to the assignee of the present application and is incorporated herein by reference in its entirety, is preferably used. Other types of deflectors, however, may also be used.

The deflector 22 has a bore 36 for insertion of a shaft 34 therethrough. As can be seen in FIG. 4, the bore 36 is defined at its lower end by circumferentially-arranged, downwardly-protruding teeth 37. As described further below, these teeth 37 are sized to engage corresponding teeth 66 on the valve sleeve 64. This engagement allows a user to depress the deflector 22 and thereby directly engage and drive the valve sleeve 64 for adjusting the valve 14. Also, the deflector 22 may optionally include a screwdriver slot and/or a coin slot in its top surface (not shown) to allow other methods for adjusting the valve 14. Optionally, the deflector 22 may also include a knurled external surface along its top circumference to provide for better gripping by a user making an arc adjustment.

The deflector 22 also preferably includes a speed control brake to control the rotational speed of the deflector 22. In one preferred from shown in FIGS. 2-4, the speed control brake includes a friction disk 28, a brake pad 30, and a seal retainer 32. The friction disk 28 preferably has a splined internal surface for engagement with a splined surface on the shaft 34 so as to fix the friction disk 28 against rotation. The seal retained 32 is preferably welded to, and rotatable with, the deflector 22 and, during operation of the nozzle 10, is urged against the brake pad 30, which, in turn, is retained against the friction disk 28. Water is directed upwardly and strikes the deflector 22, pushing the deflector 22 and seal retainer 32 upwards and causing rotation. In turn, the rotating seal retainer 32 engages the brake pad 30, resulting in frictional resistance that serves to reduce, or brake, the rotational speed of the deflector 22. The nozzle 10 preferably includes a resilient member 29, such as a conical spring, that is biased to limit upward movement of the friction disk 28. A speed brake like the type shown in U.S. patent application Ser. No. 13/495,402, which is assigned to the assignee of the present application and is incorporated herein by reference in its entirety, is preferably used. Although the speed control brake is shown and preferably used in connection with nozzle 10 described and claimed herein, other brakes or speed reducing mechanisms are available and may be used to control the rotational speed of the deflector 22.

The deflector 22 is supported for rotation by shaft 34. Shaft 34 extends along a central axis C-C of the nozzle 10, and the deflector 22 is rotatably mounted on an upper end of the shaft 34. As can be seen from FIGS. 2-4, the shaft 34 extends through the bore 36 in the deflector 22 and through aligned bores in the friction disk 28, brake pad 30, and seal retainer 32, respectively. A cap 12 is mounted to the top of the deflector 22. The cap 12 prevents grit and other debris from coming into contact with the components in the interior of the deflector 22, such as the speed control brake components, and thereby hindering the operation of the nozzle 10.

Figure 2:
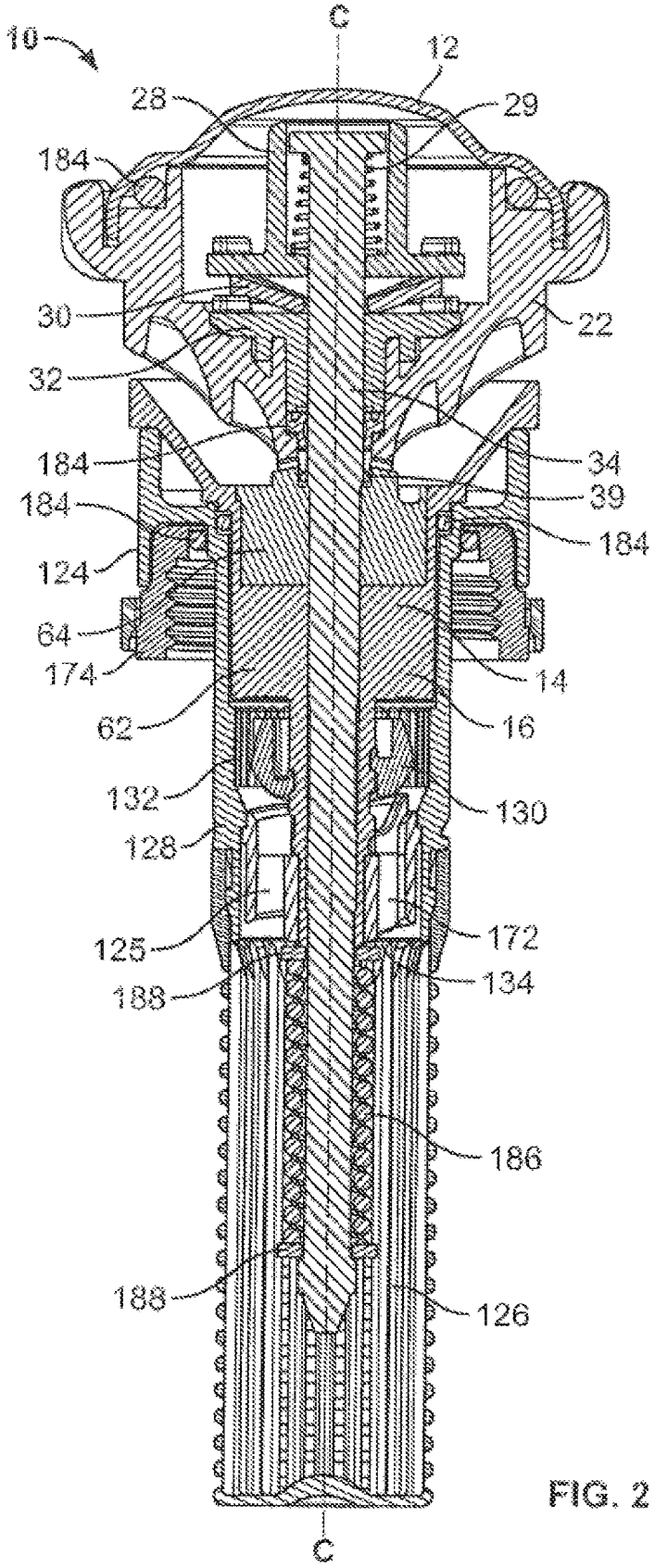
FIG. 2 is a cross-sectional view of the nozzle of FIG. 1.

A spring 186 mounted to the shaft 34 energizes and tightens the seal of the closed portion of the arc adjustment valve 14. More specifically, the spring 186 operates on the shaft 34 to bias the first of the two nozzle body portions that forms the valve 14 (valve sleeve 64) downwardly against the second portion (nozzle housing 62). By using a spring 186 to maintain a forced engagement between valve sleeve 64 and nozzle housing 62, the sprinkler head 10 provides a tight seal of the closed portion of the arc adjustment valve 14, concentricity of the valve 14, and a uniform jet of water directed through the valve 14. In addition, mounting the spring 186 at one end of the shaft 34 results in a lower cost of assembly. As can be seen in FIG. 2, the spring 186 is mounted near the lower end of the shaft 34 and downwardly biases the shaft 34. In turn, the shaft shoulder 39 exerts a downward force on the valve sleeve 64 for pressed fit engagement with the nozzle housing 62.

The arc adjustment valve 14 allows the nozzle 10 to function as a left strip nozzle, a right strip nozzle, and a side strip nozzle. As used herein a left strip refers to a rectangular area to the left of the nozzle, and conversely, a right strip refers to a rectangular area to the right of the nozzle. Further, as used herein, a side strip refers to a rectangular irrigation area in which the nozzle is positioned at the midpoint of one of the legs of the rectangle.

As described further below, the arc adjustment valve 14 may be adjusted by a user to transform the nozzle 10 into a left strip nozzle, a right strip nozzle, or a side strip nozzle, at the user's discretion. The user adjusts the valve 14 by depressing the deflector 22 to engage a valve body (valve sleeve 64) and then rotating the valve body between at least three different positions. The first position allows the nozzle 10 to function as a left strip nozzle, the second position allows it to function as a right strip nozzle, and the third position allows it to function as a side strip nozzle.

Figure 3A:
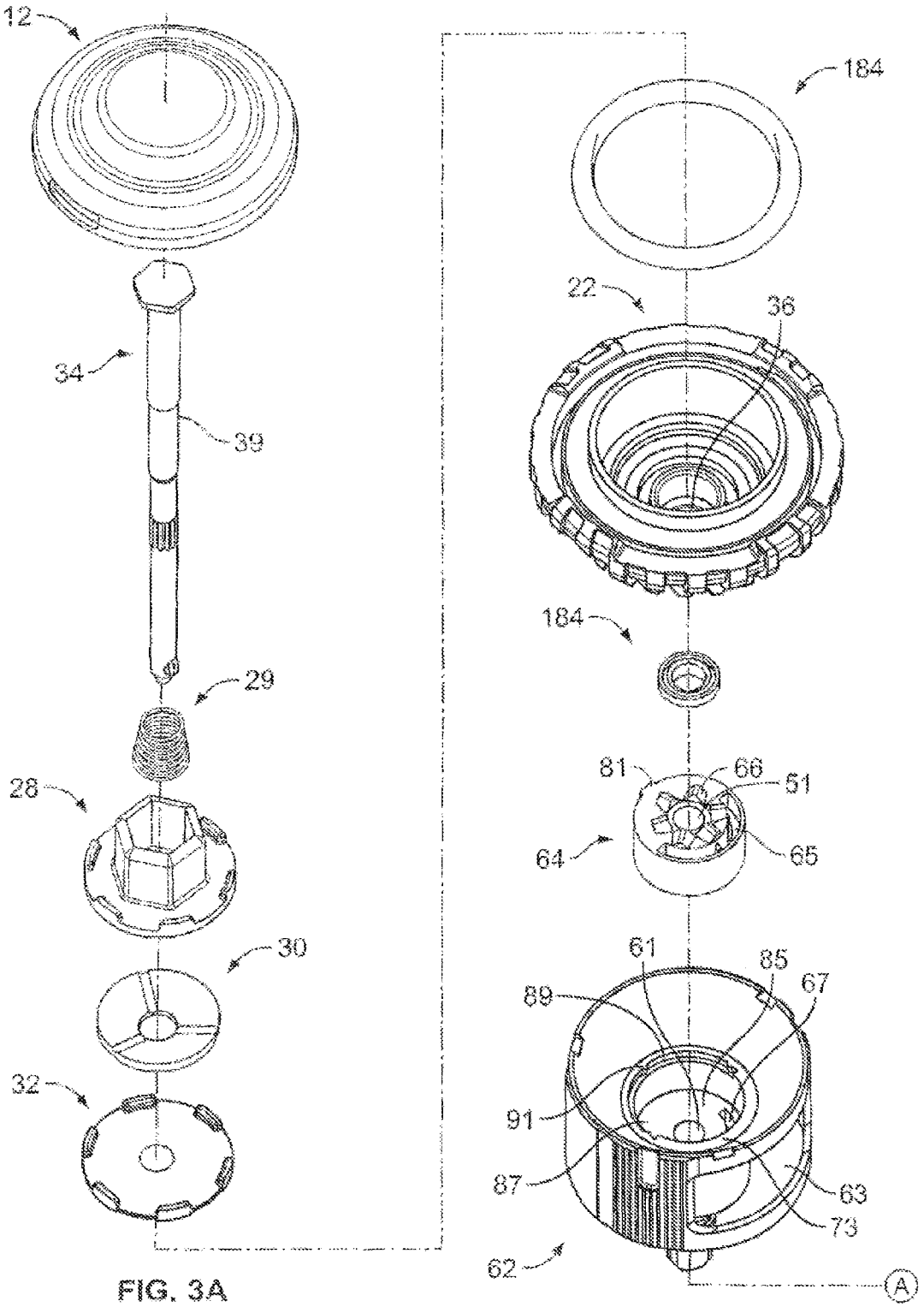
FIGS. 3A and 3B are top exploded perspective views of the nozzle of FIG. 1.
Figure 3B:
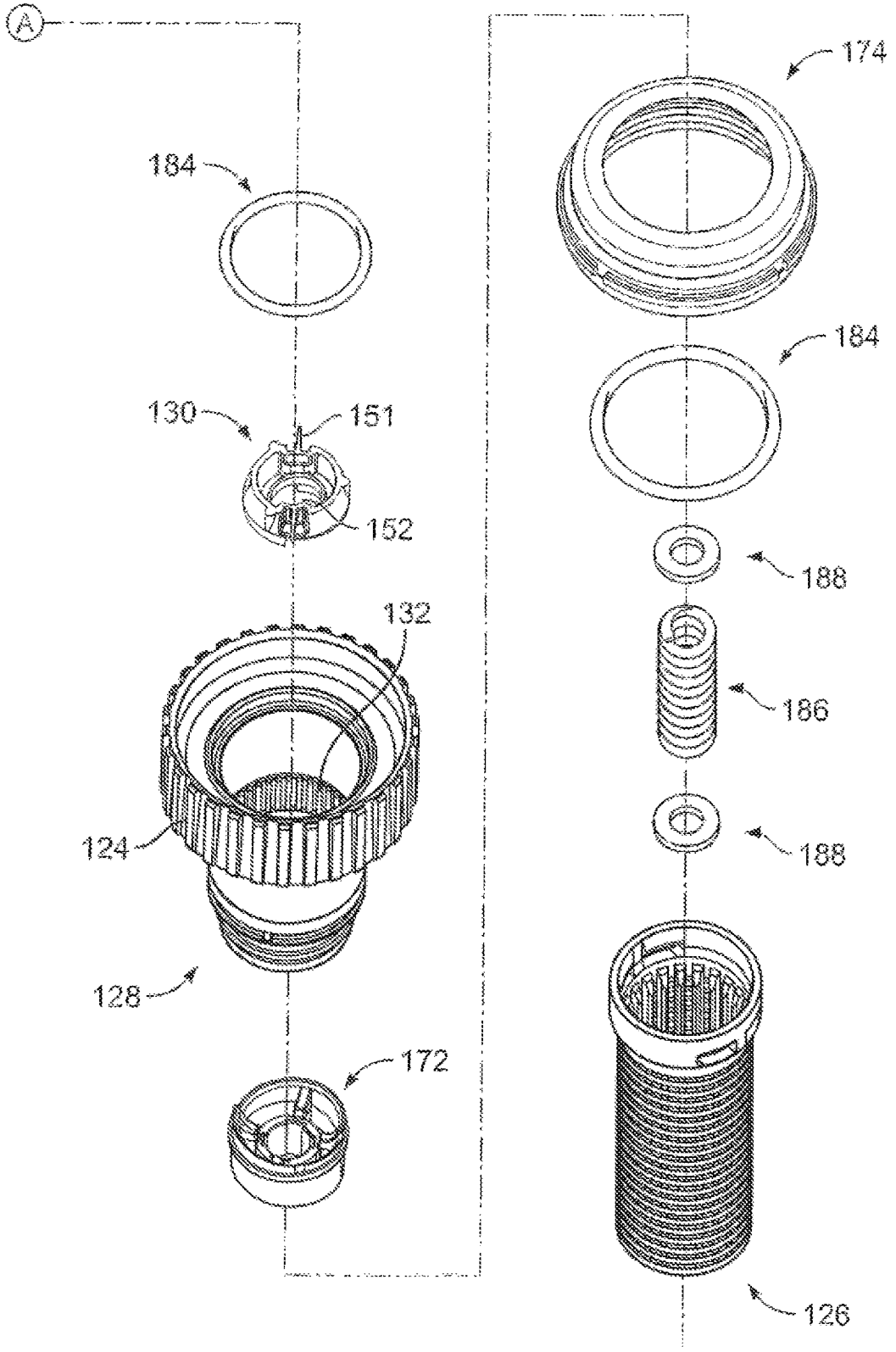

The valve 14 preferably includes two valve bodies that interact with one another to adjust the strip setting: a rotating valve sleeve 64 and a non-rotating nozzle housing 62. As shown in FIGS. 2-4, the valve sleeve 64 is generally cylindrical in shape and, as described above, includes a top surface with teeth 66 for engagement with corresponding teeth 37 of the deflector 22. When the user depresses the deflector 22, the two sets of teeth engage, and the user may then rotate the deflector 22 to effect rotation of the valve sleeve 64 to set the desired strip of irrigation. The valve sleeve 64 also includes a central bore 51 for insertion of the shaft 34 therethrough.

Figure 5:
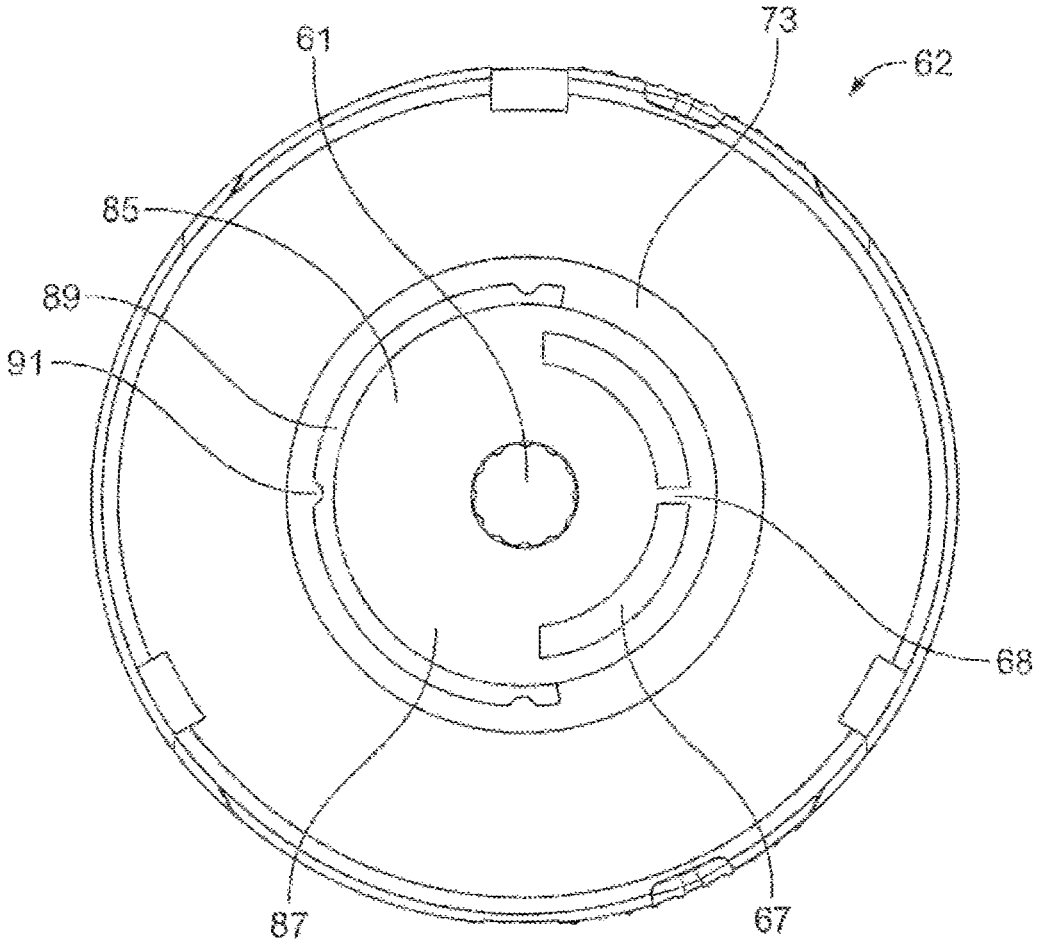
FIG. 5 is a top plan view of the unassembled valve sleeve and nozzle housing of the nozzle of FIG. 1.
Figure 5:
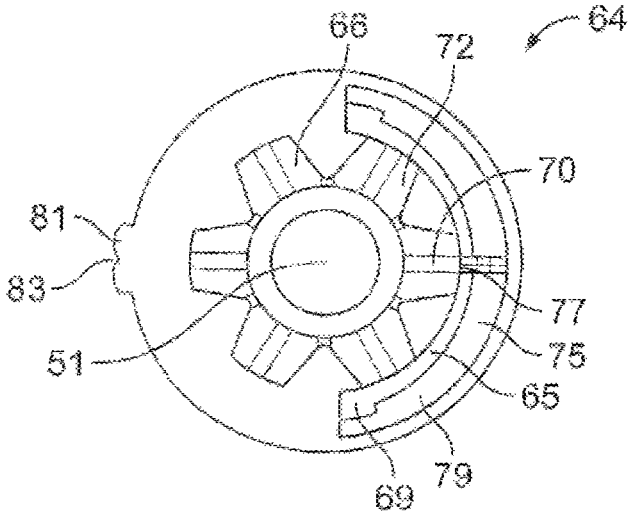
Figure 6:
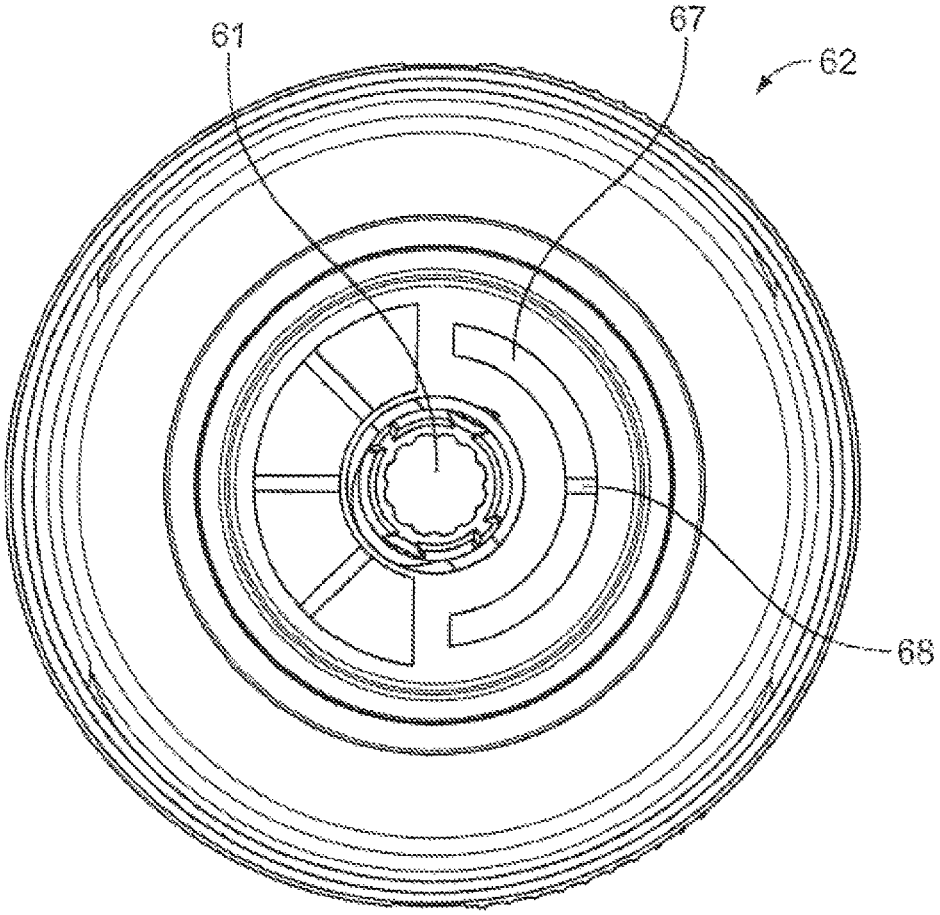
FIG. 6 is a bottom plan view of the unassembled valve sleeve and nozzle housing of the nozzle of FIG. 1.
Figure 6:
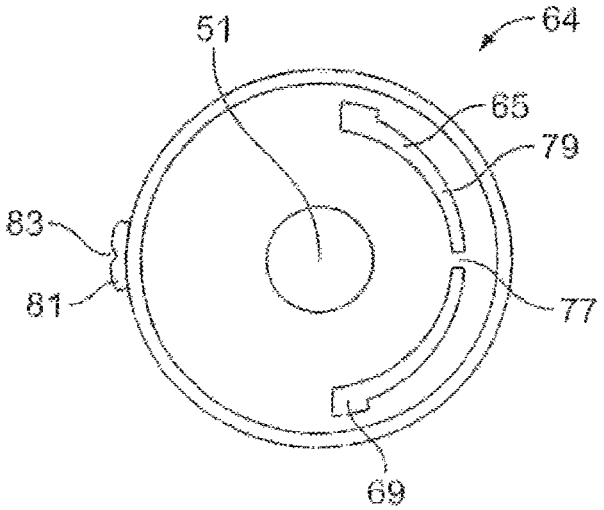

The nozzle 10 preferably allows for over-rotation of the deflector 22 without damage to nozzle components. More specifically, the deflector teeth 37 and valve sleeve teeth 66 are preferably sized and dimensioned such that rotation of the deflector 22 in excess of a predetermined torque results in slippage of the teeth 37 out of the teeth 66. In one example, as shown in FIG. 5, there are preferably six valve sleeve teeth 66 with each tooth forming the general shape of an isosceles triangle in cross-section with rounded apexes 70. The legs 72 of each triangle form an angle of about 49.5 degrees with the base and about 81 degrees at the apex 70 when the legs 72 are extended. The radius of curvature of the rounded apex 70 is preferably about 0.010 inches. The inner radius of the teeth 66 is about 0.07 inches, and the radial width of each tooth is about 0.051 inches. Thus, the user can continue to rotate the deflector 22 without resulting in increased, and potentially damaging, force on the valve sleeve 64 and nozzle housing 62.

The valve sleeve 64 further includes an arcuate slot 65 that extends axially through the body of the valve sleeve 64. As can be seen, the arcuate slot 65 preferably extends nearly 180 degrees about the central bore 51 to generally form a semicircle. On the top surface of the valve sleeve 64, the arcuate slot 65 is disposed near the outer circumference (radially outwardly from the teeth 66), and the slot 65 is fairly uniform in width. On the bottom surface of the valve sleeve 64, however, the arcuate slot 65 is generally narrower and is not uniform in width. Instead, on the bottom surface, the arcuate slot 65 has two relatively wide and generally stepped flow openings, or notches, defining two channels 69 at either end of the arcuate slot 65. The arcuate slot 65 tapers as one proceeds from the channels 69 to the middle of the arcuate slot 65. A wall 77 is disposed in and extends through much of the body of the valve sleeve 64 and divides the slot 65 into two relatively equal arcuate halves. Each arcuate half of the slot 65 defines nearly 90 degrees. Further, a step 75 (FIG. 5) within the body of the valve sleeve 64 increases the width of the arcuate slot 65 as fluid proceeds axially from the bottom surface to the top surface.

The bottom surface acts as an inlet for fluid flowing through the valve sleeve 64, and the top surface acts as an outlet for fluid exiting the valve sleeve 64. The interior of the valve sleeve 64 defines two chambers 79 (separated by the divider wall 77) for fluid flowing through the valve sleeve 64. As can be seen in FIGS. 3-6, the outlet has a larger cross-sectional area that the inlet, causing the fluid to expand and the fluid velocity to be reduced as it flows through the valve sleeve 64. The divider wall 77 prevents fluid flowing through one chamber from entering the other chamber, which would otherwise disrupt an edge of the rectangular irrigation pattern.

One form of an arcuate slot 65 is described above and shown in FIGS. 3-6, but it should be evident that the precise shape and dimensions of the arcuate slot 65 may be modified to create other irrigation patterns and coverage areas. For example, the shape and dimension of the notch 69 at one or both ends of the slot 65 may be modified, such as by engaging the notch 69 or by changing the orientation or dimensions of the notch 69. Elimination of the enlarged notch 69 entirely may result in a more triangular irrigation pattern. As an additional example, the degree of tapering of the slot 65 may be modified or the tapering may be reversed such that the middle of the slot 65 is wider than points near the ends. Slots having a uniform width generally result in irrigation areas that are substantially arcuate in coverage. Here, in contrast, it is contemplated that the slot 65 may be designed in numerous ways with a non-uniform width, thereby result in substantially polygonal irrigation areas.

The outer perimeter of the valve sleeve 64 also includes a feedback feature to aid the user in setting the nozzle 10 to three different positions (left strip, right strip, and side strip), as explained further below. The feedback feature may be a boss 81 that extends radially outward from the outer circumference and that includes a recess or notch 83 in the boss 81. As described further below, the recess 83 receives a portion of the nozzle housing 62 to allow a user to feel (they "click" together) that the user has adjusted the valve sleeve 64 to a desired strip setting.

As shown in FIGS. 2-3, the nozzle housing 62 includes a cylindrical recess 85 that receives and supports the valve sleeve 64 therein. The nozzle housing 62 has a central hub 87 that defines a central bore 61 that receives the shaft 34, which further supports the valve sleeve 64. The central hub 87 defines a second arcuate slot 67 extending axially through the body of the nozzle housing 62 that cooperates with the first arcuate slot 65 of the valve sleeve 64. As explained further below, the valve sleeve 64 may be rotated so that the first and second arcuate slots 65 and 67 are aligned with respect to one another or staggered some amount with respect to one another. Like the first arcuate slot 65, the second arcuate slot 67 also extends nearly 180 degrees about the central bore 61 and is divided by a wall 68. Unlike the first arcuate slot 65, however, it has a fairly uniform width as one proceeds axially from its bottom surface to its top surface.

The nozzle housing 62 has a circumferential ledge 89 to allow the boss 81 of the valve sleeve 64 to ride therein. The ledge 89 preferably does not extend along the entire circumference but extends approximately 270 degrees about the circumference. When the user rotates the valve sleeve 64, the boss 81 travels along and is guided by the ledge 89. An arcuate wall 73 prevents clockwise and counterclockwise rotation of the valve sleeve 64 beyond two predetermined end positions.

The nozzle housing 62 also preferably includes at least three inwardly directed detents 91 located just above the ledge 89. The detents 91 are positioned roughly equidistantly from one another (preferably about 90 degrees from one another) so that a detent can click into position in the recess 83 of the boss 81 as the valve sleeve 64 is rotated. As explained further below, these three settings correspond to left strip, right strip, and side strip irrigation. In other words, in these three settings, the first and second arcuate slots 65 and 67 are oriented with respect to one another to allow left strip, right strip, and side strip irrigation. When the user feels a detent 91 click into place in the recess 83 of the boss 81, he or she knows that the nozzle 10 is at the desired strip setting.

FIGS. 7A-C and 8A-C show the alignment of the valve sleeve 64 and nozzle housing 62 in different strip settings when viewed from above. In FIG. 7A, the valve sleeve 64 and nozzle housing 62 are in a side strip setting, in which the middle detent 91 of the nozzle housing 62 is received within the recess 83. In this setting, the nozzle 10 is at the midpoint of the top leg of a rectangular irrigation pattern.

This alignment creates a side strip pattern through the use of two channels 69 at either end of the arcuate slot 65 that taper as one proceeds towards the midpoint of the arcuate slot 65. The channels 69 allow a relatively large stream of fluid to be distributed laterally to the left and right sides of the figure. The tapering of the arcuate slot 65 means the slot 65 is relatively narrow at the bottom of the figure, which reduces the radius of throw in that direction. The resulting irrigation pattern is one in which a substantially large amount of fluid is directed laterally while a relatively small amount is directed in a downward direction, thereby resulting in a substantially rectangular irrigation pattern with the nozzle 10 at the midpoint of the top horizontal leg (FIG. 7D).

In FIG. 7B, the valve sleeve 64 and nozzle housing 62 are in a right strip setting. As can be seen in the figure, the valve sleeve 64 has been rotated about 90 degrees counterclockwise from the side strip setting. The user rotates the deflector 22 (in engagement with the valve sleeve 64) about 90 degrees until the user feels the detent 91 click into the recess 83, which indicates the nozzle 10 is now in the right strip setting. In this setting, the nozzle 10 irrigates a rectangular strip that extends to the right of the nozzle 10 with the longer leg of the rectangle extending in a downward direction (FIG. 7E).

In FIG. 7C, the valve sleeve 64 has been rotated counterclockwise from the right strip setting until the boss 81 engages the arcuate wall 73, thereby preventing further counterclockwise rotation. The valve sleeve 64 has been rotated about 45 degrees clockwise from the right strip setting. As can be seen in the figures, in this position, the first and second arcuate slots 65 and 67 are oriented with respect to one another so that only about 45 degrees of the valve 14 is open with the open portion 20 extending from a channel 69 halfway to the divider wall 77. In this right corner setting, fluid is distributed in an irregularly shaped, generally trapezoidal irrigation area within a 45 degree arcuate span (FIG. 7F).

Figure 8A:
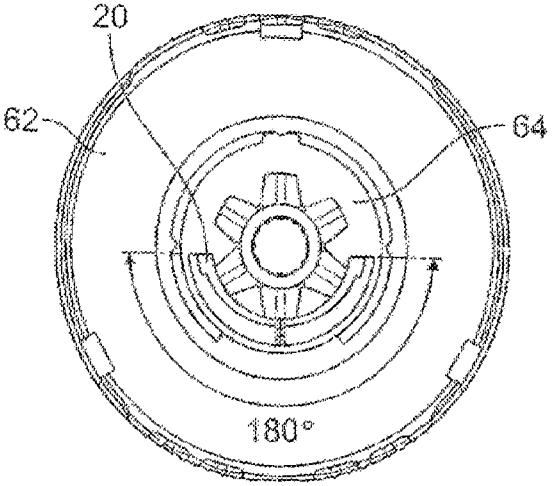
FIGS. 8A-C are top plan views of the assembled valve sleeve and nozzle housing of the nozzle of FIG. 1 in a side strip (180 degree), right strip (90 degree) and right corner (45 degree) configuration, respectively.
Figure 8B:
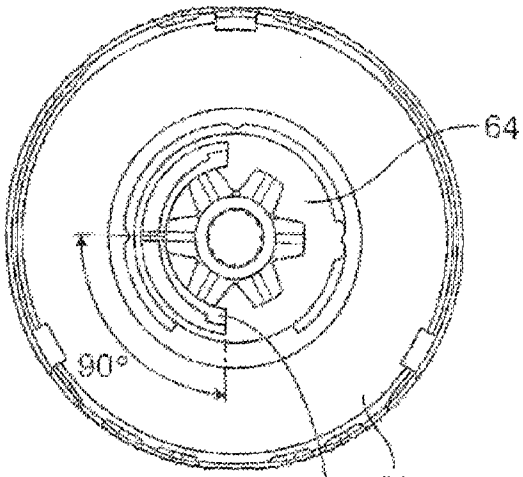
Figure 8C:
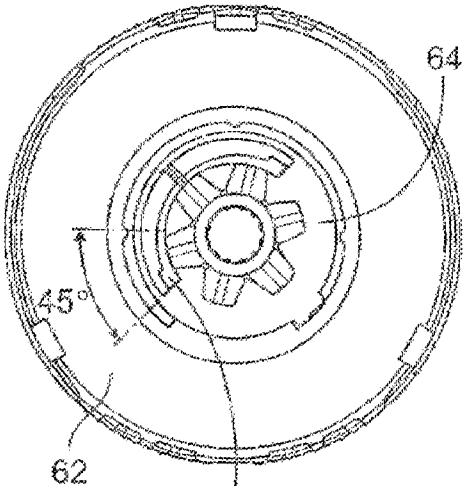
Figure 8D:
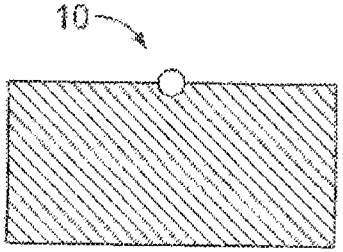
FIGS. 8D-F are representational views of the irrigation patterns and coverage areas of the side strip (180 degree), right strip (90 degree) and right corner (45 degree) configuration, respectively.

FIGS. 8A-C show the alignment of the valve sleeve 64 and nozzle housing 62 in other settings. In FIG. 8A, the valve sleeve 64 has been rotated clockwise from the last position (the 45 degree setting) until it is once again in a side strip setting, Again, as can be seen in the figure, in this setting, the middle detent 91 of the nozzle housing 62 is received within the recess 83. The side strip irrigation pattern is again shown in FIG. 8D.

Figure 8E:
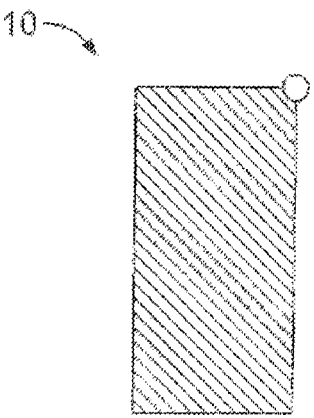

In FIG. 8B, the valve sleeve 64 and nozzle housing 62 are now in a left strip setting. As can be seen in the figure, the valve sleeve 64 has been rotated about 90 degrees clockwise from the side strip setting. Again, the valve sleeve is rotated about 90 degrees until the user feels the detent 91 click into the recess 83, indicating that the nozzle 10 is in the left strip setting. The nozzle 10 irrigates a rectangular area to the left of the nozzle 10 (FIG. 8E). By comparing FIGS. 7E and 8E, it can be seen that the strips cover different rectangular areas such that rotation of the entire nozzle 10 does not cause these two rectangular areas to completely overlap.

Figure 8F:
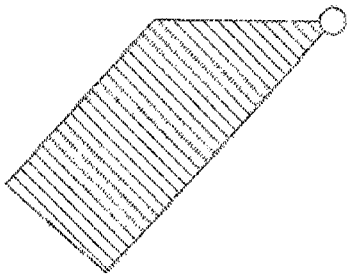

In FIG. 8C, the valve sleeve 64 has been rotated clockwise from the left strip setting about 45 degrees until the boss 81 engages the arcuate wall 73. The valve sleeve 64 cannot be rotated further in a clockwise direction. In this left corner setting, only about 45 degrees of the valve 14 is open, and fluid is distributed in an irregularly shaped, generally trapezoidal irrigation area within a 45 degree arcuate span (FIG. 8F).

Figure 9:
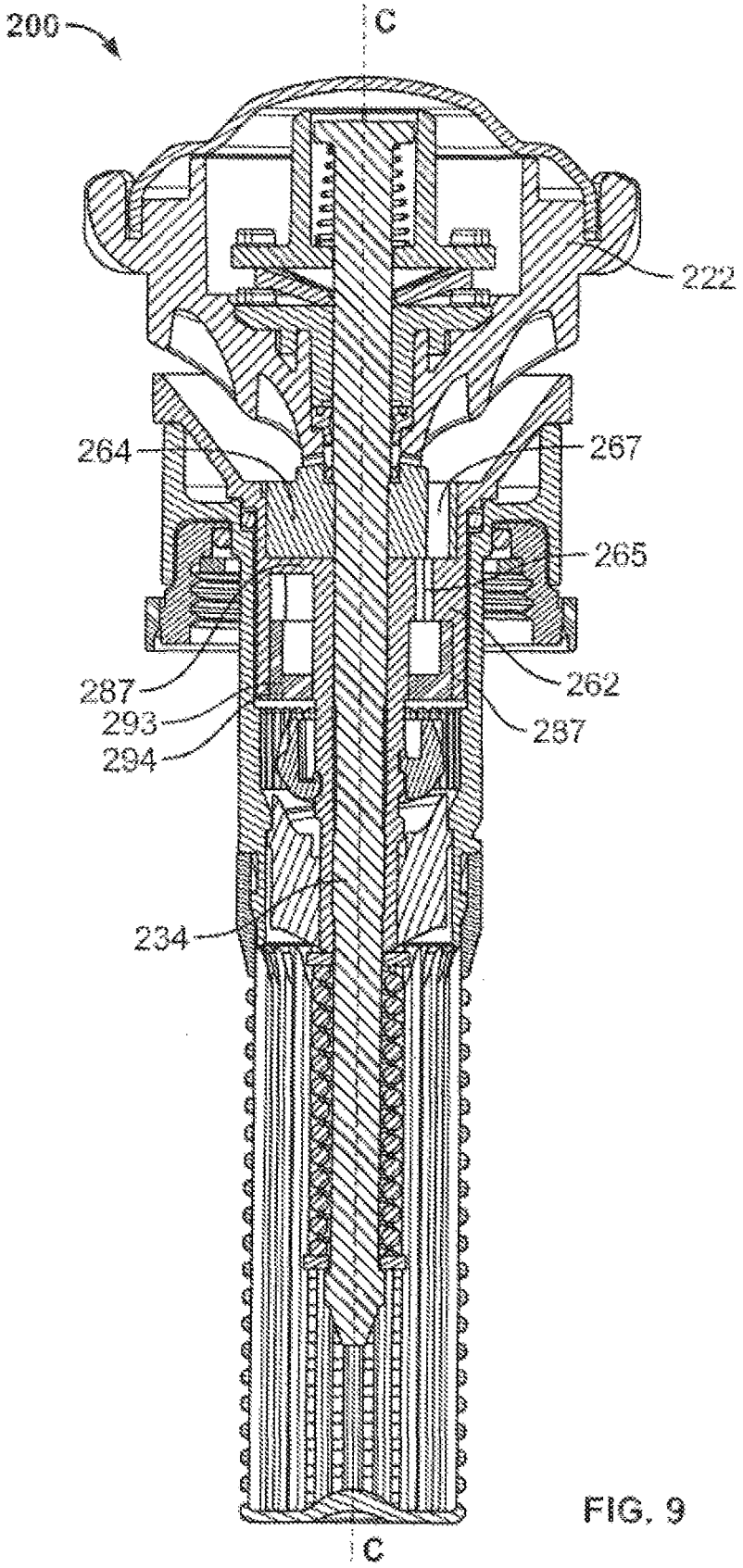
FIG. 9 is a cross-sectional view of a second embodiment of a nozzle having a restrictor.

A second preferred from (nozzle 200) is shown in FIG. 9. In this preferred form, the general shapes of the arcuate slots 265 and 267 in the nozzle housing 262 and valve sleeve 264 have been switched. In other words, in this form, the nozzle housing 262 (instead of the valve sleeve 264) has an arcuate slot 265 of non-uniform width. The arcuate slot 265 has a channel 269 at each end of the slot 265, and the slot 265 tapers as one proceeds to a dividing wall 277 in the middle of the slot 265. In contrast, the arcuate slot 267 in the valve sleeve 264 has a uniform width.

Figure 10:
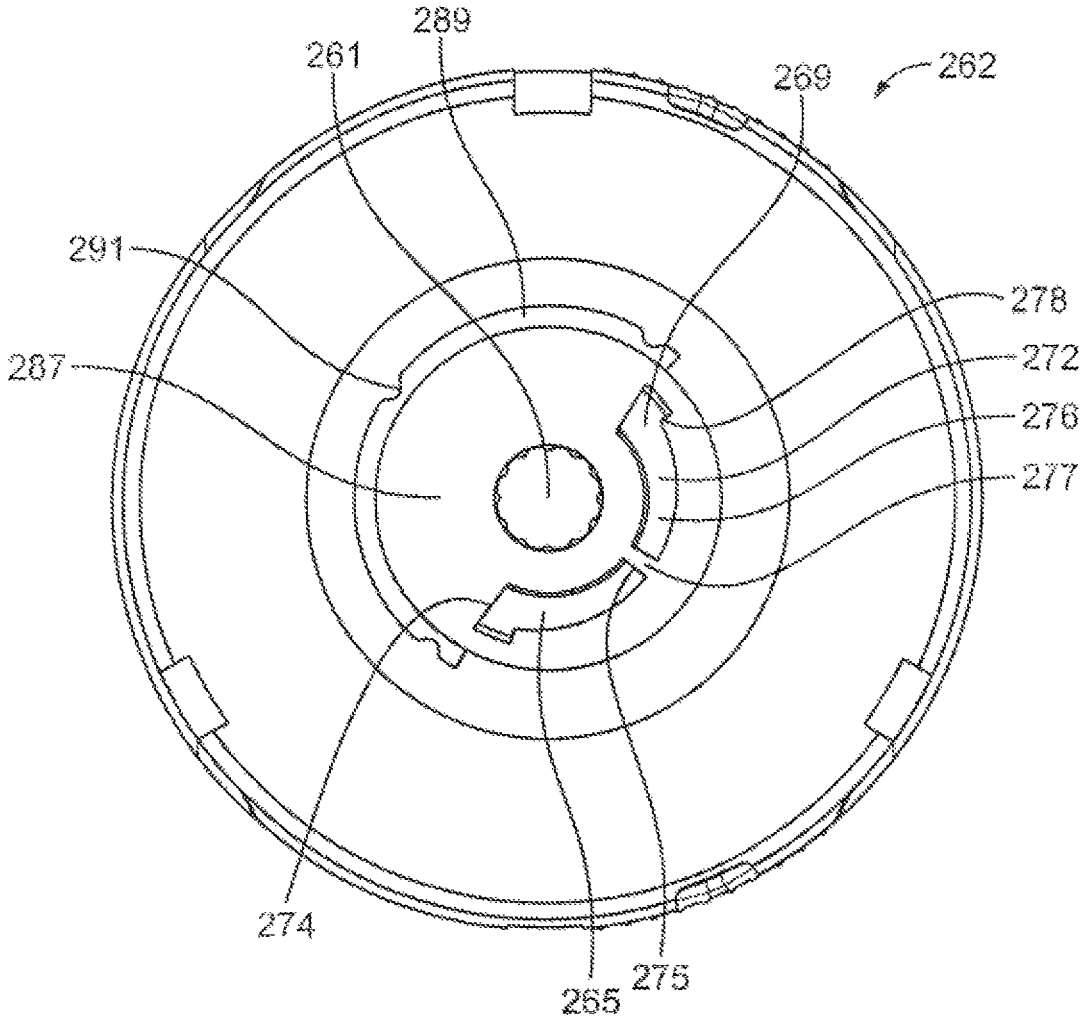
FIG. 10 is a top plan view of the unassembled valve sleeve and nozzle housing of the nozzle of FIG. 9.
Figure 10:
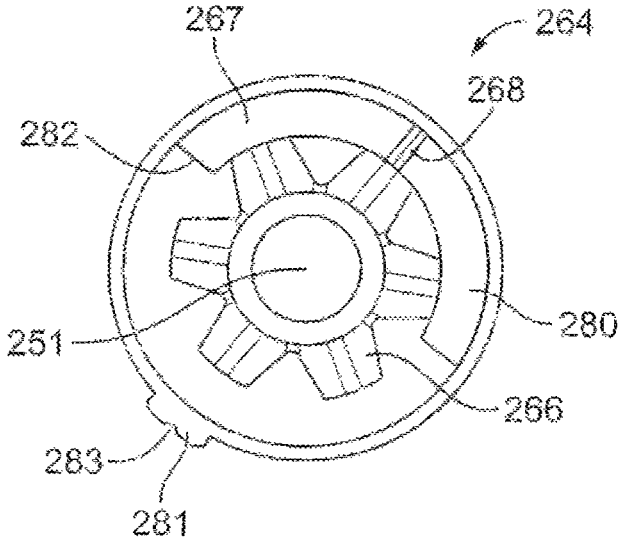
Figure 11:
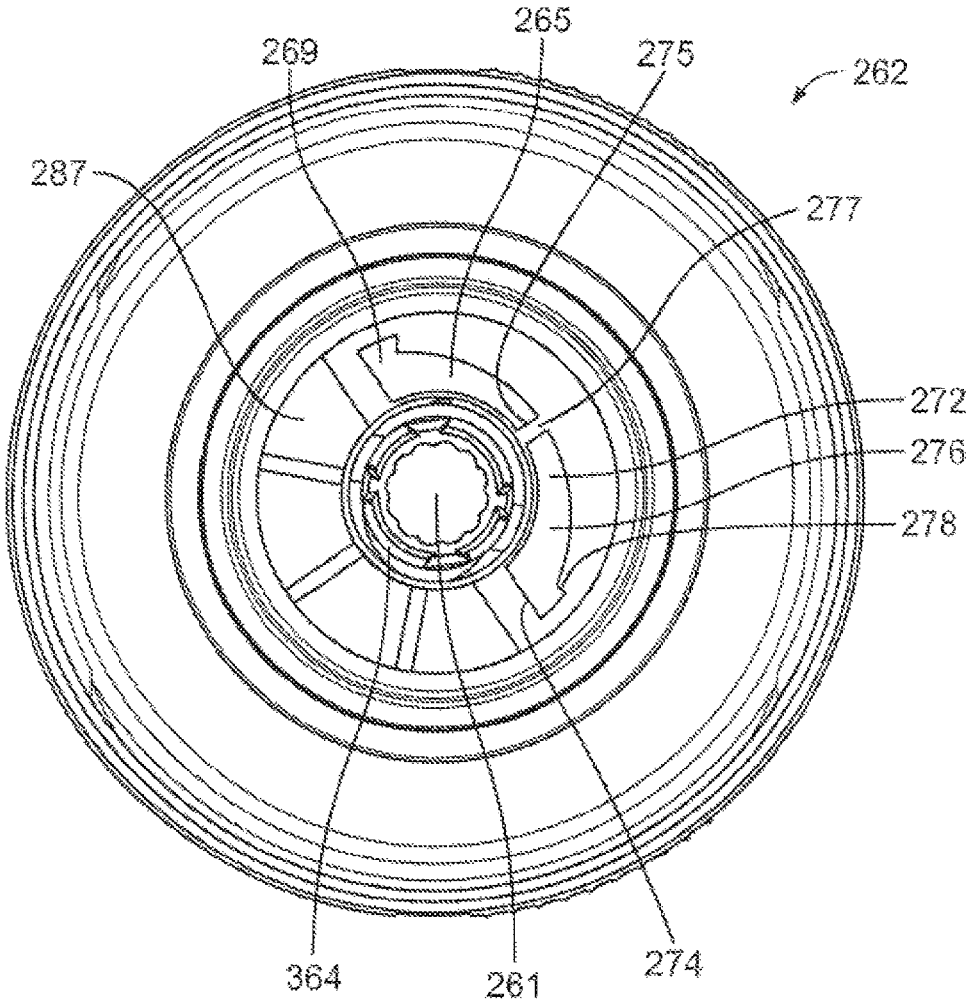
FIG. 11 is a bottom plan view of the unassembled valve sleeve and nozzle housing of the nozzle of FIG. 9.
Figure 11:
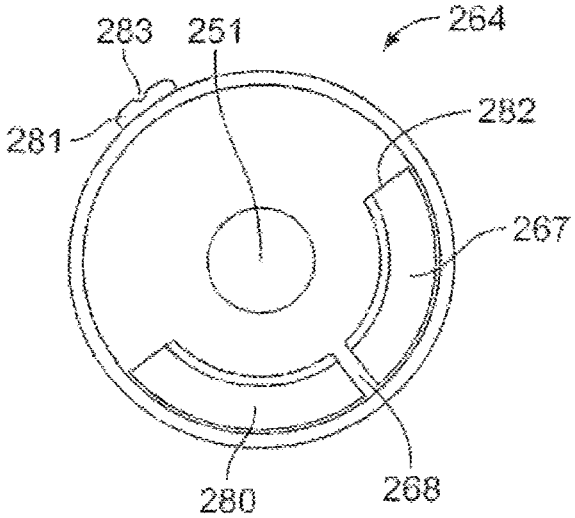

As can be seen in FIGS. 10 and 11, the nozzle housing 262 has the arcuate slot 265 that is shaped in a non-uniform manner to provide right strip, left strip, and side strip irrigation. The arcuate slot 265 preferably extends nearly 180 degrees, has two relatively wide and generally stepped flow openings, or notches, defining two channels 269 at each end, and tapers as one proceeds from the channels 269 to the dividing wall 277. Again, it should be evident that the precise shape and dimensions of the arcuate slot 265 may be tailored to create other various substantially polygonal irrigation patterns and coverage areas.

Otherwise, the structure and operation of the nozzle housing 262 is similar to that described above in the first embodiment. The nozzle housing 262 includes a cylindrical recess that receives and supports the valve sleeve 264 therein. It has a central hub 287 that defines a central bore 262 for receiving the shaft 234. The nozzle housing 262 has a circumferential ledge 289 to allow the boss 281 of the valve sleeve 264 to ride therein for adjustment between predetermined settings. It also includes inwardly directed detents 291 to allow a user to rotate the valve sleeve 264 to left strip, right strip, and side strip irrigation settings.

The valve sleeve 264 is also shown in FIGS. 10 and 11, and as can be seen, the arcuate slot 267 of the valve sleeve 264 has a uniform width. The arcuate slot 267 preferably has a wall 268 extending partially through the valve sleeve 264 that divides the slot 267 into two generally equal halves. Otherwise, however, the structure and operation of the valve sleeve 264 is similar to that described above for the first embodiment. The valve sleeve 264 has a top surface with teeth 266 for engagement with, and rotation by, corresponding teeth of the deflector 222. The valve sleeve 264 is disposed within the nozzle housing 262 and includes a central bore 251 for receiving the shaft 234. The valve sleeve 264 also preferably includes a boss 281 with a recess or notch 283 in the boss 281 that cooperates with the detents 291 of the nozzle housing 262. The recess 283 receives a detent 291 to allow a user to feel that the user has adjusted the valve sleeve 264 to a desired strip setting when the detent 291 "clicks" into the recess 283.

Figure 12:
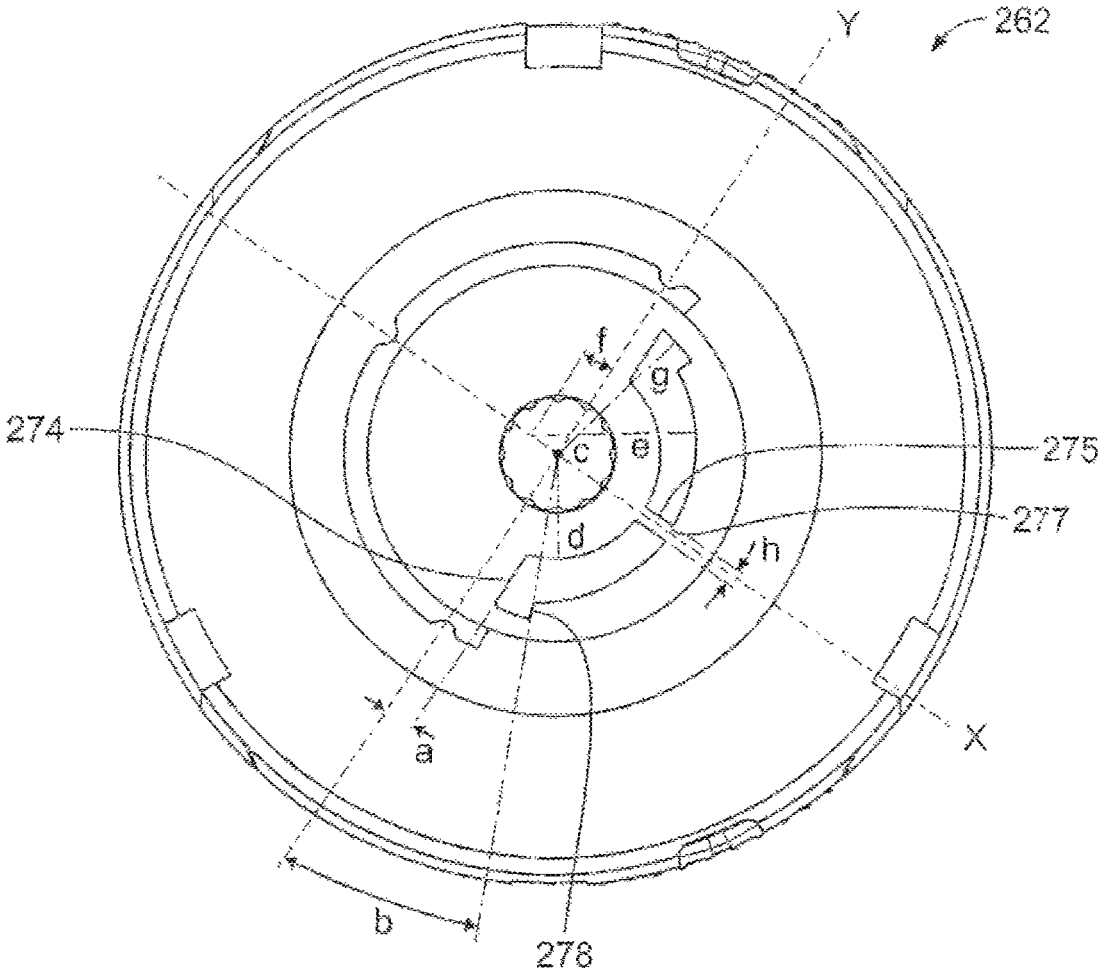
FIG. 12 is a top schematic view of the nozzle housing of the nozzle of FIG. 9.

In one example, the arcuate slots 265 and 267 of the nozzle housing 262 and valve sleeve 264 preferably have the general shape and dimensions shown in FIGS. 10-12 and described as follows. The non-uniform arcuate slot 265 includes two generally equal openings 272 separated by a divider wall 277. The divider wall 277 has a length (h) of about 0.015 inches and a width of about 0.025 inches. The arcuate slot 265 has a variable radial with that decreases as one approaches from each lateral edge 274 to the divider wall 277, and the lateral edge 274 and divider wall edge 275 form a 90 degree angle when extended to intersect one another. In this example, each opening 272 has a tapered portion 276 and a stepped end portion 269.

Each tapered portion 276 preferably has an inner radius (d) of about 0.090 inches from center C. Center C is located along the axis C-C shown in FIG. 9. As stated above, one edge 275 of each tapered portion formed by the divider wall 277 has a width of about 0.025 inches. The outer radius (e) of each tapered portion 276 is about 0.137 inches but, as shown, the circle defining the outer radius is off center from center C by a distance (f) of about 0.020 inches.

Each stepped portion 269 also preferably has an inner radius (d) of about 0.090 inches and an outer radius (g) of about 0.150 inches from center C, such that the lateral edge 274 has a width of about 0.060 inches. The lateral edge 274 is spaced a distance (a) of about 0.015 inches from the y-axis through center C. The stepped portion 269 preferably has a second radial edge 278 that forms a 19.265 degree angle (b) with the lateral edge 274 when both are extending to interest one another.

In contrast, in this example, the arcuate slot 267 of the valve sleeve 264 preferably has a uniform width. The arcuate slot 267 includes two generally equal openings 280 separated by a divider wall 268, and the divider wall 268 has an arcuate length of about 0.017 inches and a radial width of about 0.042 inches. The slot 267 preferably has an inner radius of approximately 0.121 inches centered along the C-C axis, and it has a uniform width of approximately 0.042 inches. The width therefore does not decrease as one proceeds from the lateral edges 282 to the divider wall 268 of the slot 267.

Figure 13A:
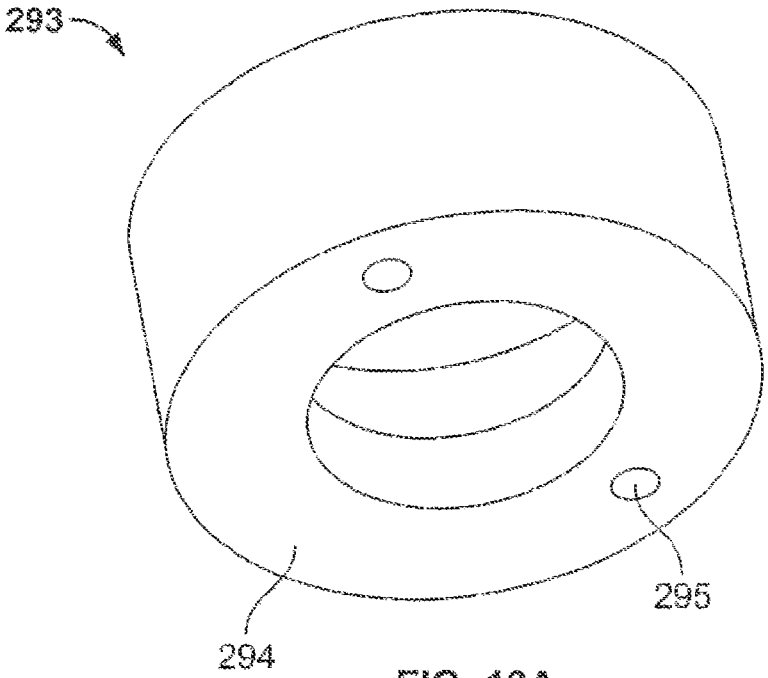
FIG. 13A is a perspective view of the restrictor of FIG. 9.

Further, a restrictor 293, as shown in FIGS. 9 and 13A is preferably added to nozzle 200 to regulate fluid flow through the nozzle housing 262 and valve sleeve 264. The restrictor 293 is preferably cylindrical in shape so as to be capable of insertion in the central hub 287 of the nozzle housing 262 upstream of the valve sleeve 264. The restrictor 293 preferably includes a lower annular plate 294 with two flow openings 295 therethrough (the flow openings 295 can be seen in FIG. 13A but are not shown in FIG. 9). When the restrictor 293 is disposed within the nozzle housing hub 287, the restrictor 293 blocks flow to the nozzle housing 262, except through the flow openings 295.

Figure 13B:
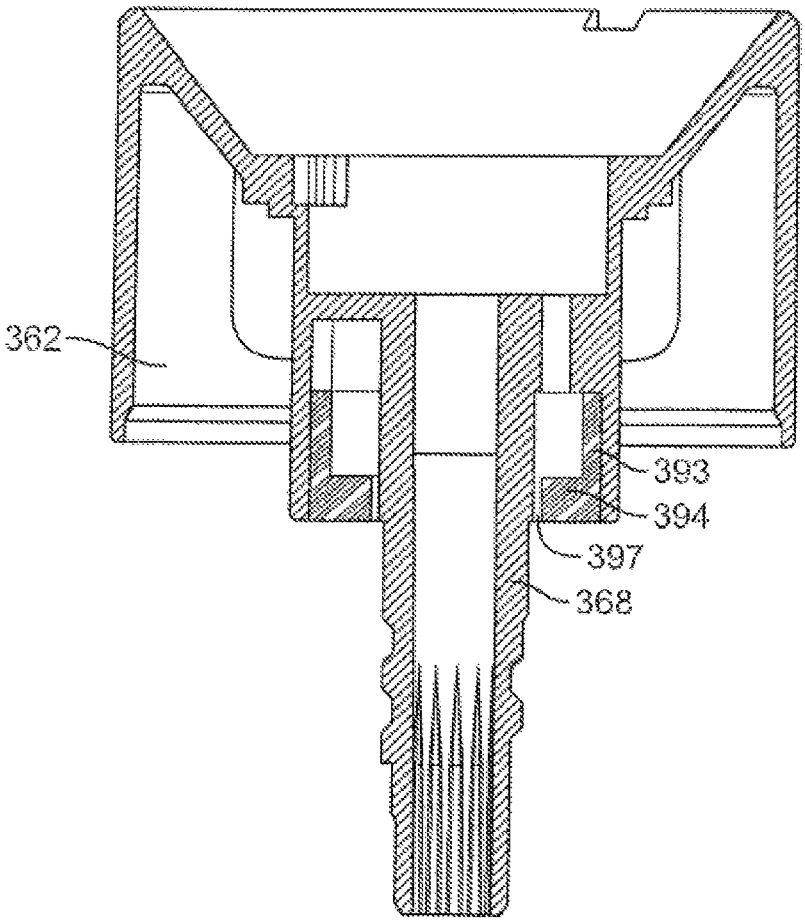
FIG. 13B is a cross-sectional view of an assembled nozzle housing and alternative restrictor.

In another form (FIG. 13B), the restrictor 393 does not have the two flow openings 295. Instead, the lower annular plate 394 has an inner radius that is greater than the outer radius of the cylindrical wall 368 of the nozzle housing 362. In other words, the lower annular plate 294 is spaced from the cylindrical wall 368. This spacing creates an annular gap 397 allowing a reduced amount of fluid to flow upwardly between the plate 394 and wall 368.

In either restrictor form, the result is that the restrictor 293 or 393 reduces the flow into and through the nozzle housing 262 or 362. It has been found that the restrictor 293 or 393 provides a tooling advantage. Without the restrictor 293 or 393, a portion of the arcuate slot in the nozzle housing 262 or 362 would have to be reduced in size to reduce flow (such as by including a relatively narrow bottom surface of the slot, an intermediate step, and a relatively wide top surface of the slot), thereby making tooling of the nozzle housing 262 or 862 more difficult and costly. In contrast, with insertion of the restrictor 293 or 393, the flow openings 295, or annular gap 397, reduce fluid flow such that the arcuate slot 265 of the nozzle housing 262 may be relatively wide. It should be evident that other shapes and forms of restrictors may be used so as to reduce the fluid flow.

Figure 14A:
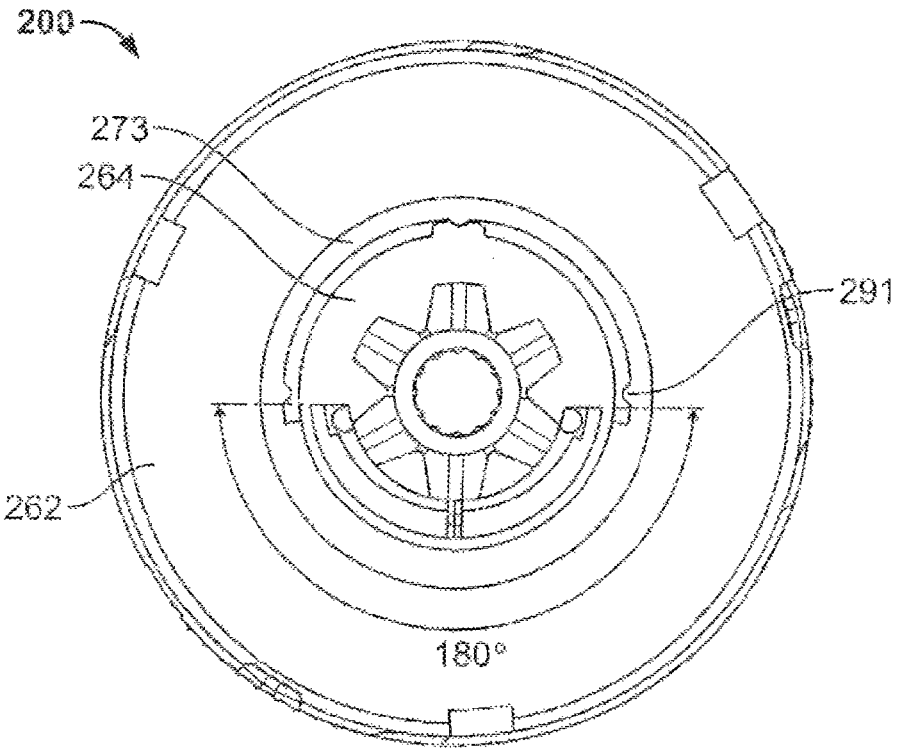
FIGS. 14A-B are top plan views of the assembled valve sleeve, nozzle housing, and restrictor of the nozzle of FIG. 9 in a side strip (180 degree) and right strip (90 degree) configuration respectively.
Figure 14B:
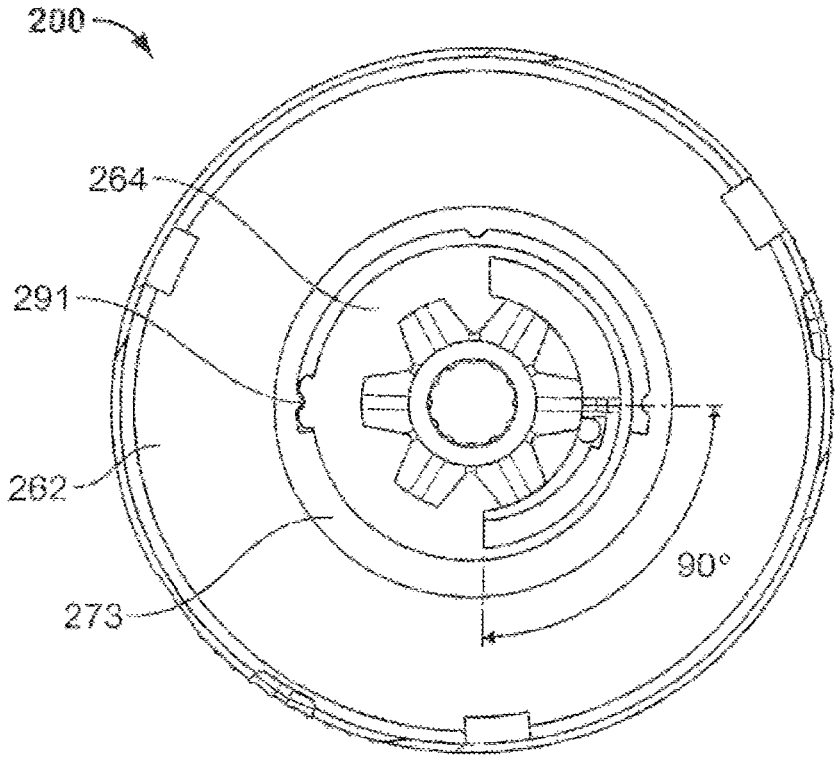

Also, in this preferred form, it is contemplated that the valve sleeve 264 may be adjustable within only about 180 degrees of rotation (and not 270 degrees as described above), and the arcuate wall 273 is extended to block the remaining 180 degrees of rotation, as shown in FIGS. 14A-B. In this form, the 45 degree irrigation settings described above have been eliminated, and the arcuate opening is generally adjustable between about 90 and 180 degrees. FIG. 14A shows the nozzle 200 in a side strip setting, and in FIG. 14B, the valve sleeve 264 has been rotated counterclockwise about 90 degrees to place the nozzle 200 in a right strip setting. The user can still rotate from the side strip setting counterclockwise or clockwise to a right or left strip setting, respectively, but further rotation is blocked by the arcuate wall 273. As shown in FIGS. 14A-B, detents 291 corresponding to the right and left strip settings are preferably located near the ends of the arcuate wall 273. It is contemplated that this arrangement may be user friendly by limiting clockwise and counterclockwise movement in certain settings. For example, when the valve sleeve 264 is in a right strip setting, a user can intuitively feel that the valve sleeve 264 may only be rotated in one direction to reach the side strip and left strip settings, rather than permitting the user to rotate the valve sleeve 264 in the wrong direction.

As should be evident, nozzle 200 operates in substantially the same manner for left strip, right strip, and side strip irrigation as described above for nozzle 10. The user rotates the valve sleeve 262 clockwise or counterclockwise to switch between left strip, right strip, and side strip settings. With respect to nozzle 200, however, it is the non-uniform width of the arcuate slot of the nozzle housing (rather than the arcuate slot of the valve sleeve) that results in the polygonal area of coverage. Further, it should be evident that the restrictor 293 or 393 and the 180 degree arcuate wall 273 could also be used in conjunction with the first embodiment (nozzle 10).

Figure 15:
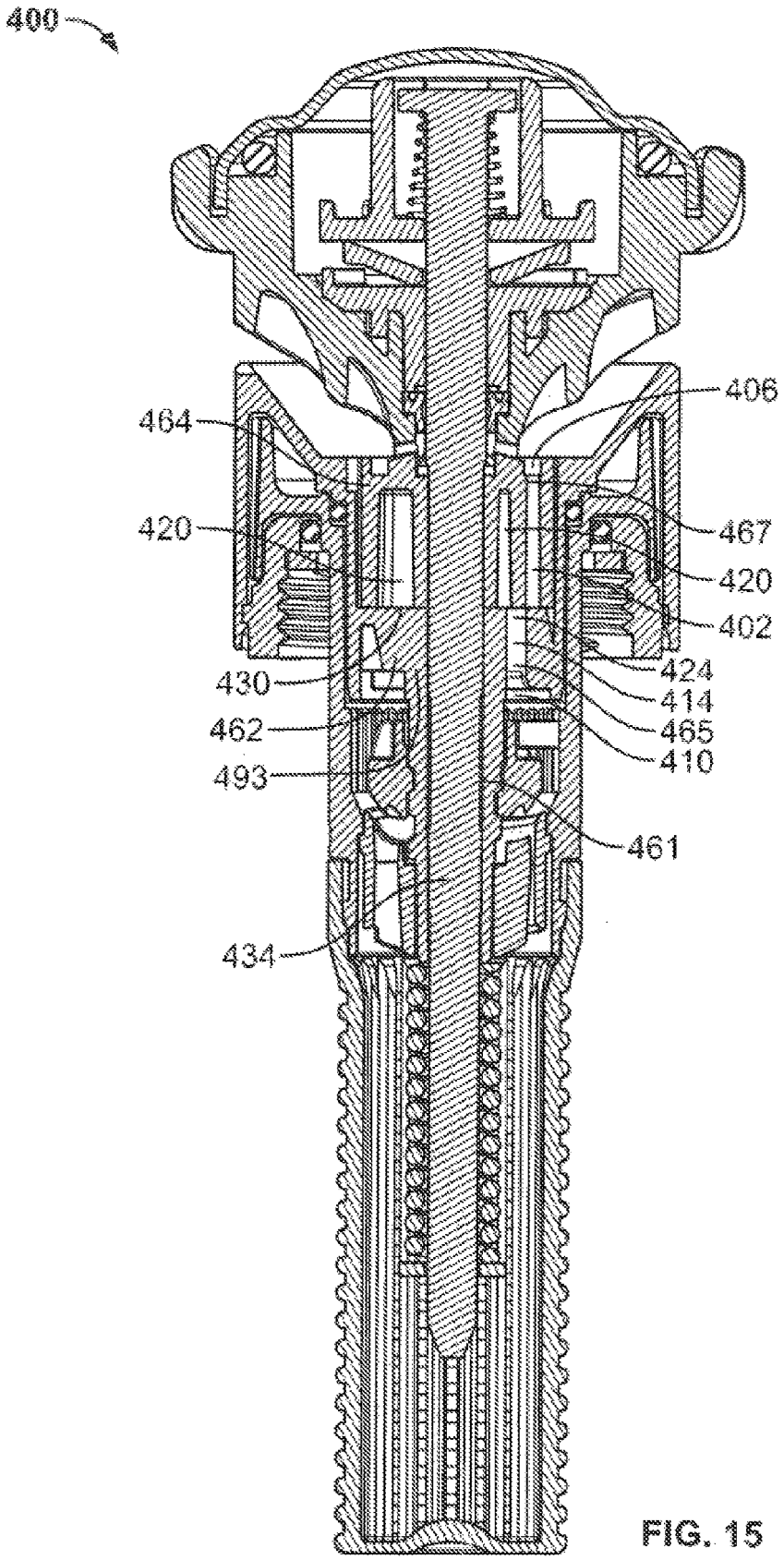
FIG. 15 is a cross-sectional view of a third embodiment of a nozzle embodying features of the present invention.

Another preferred form of a nozzle 400 is illustrated in FIG. 15. As addressed further below, in this preferred form, the valve sleeve 464 is generally similar in structure to the previously-described valve sleeve 264. However, the nozzle housing 462 has been modified to include a unitary restrictor portion 493 as part of the housing 464 to reduce upward fluid flow. This restrictor portion 493 provides for a matched precipitation rate of the strip nozzle 400, irrespective of the irrigation setting of the strip nozzle. In other words, the precipitation rate of the strip nozzle 400 is the same, regardless of whether the strip nozzle is in a left strip, right strip, or side strip setting, as addressed further below. Otherwise, the structure and operation of the nozzle 400 and of its components is generally similar to nozzles 10 and 200. The valve sleeve 464 and nozzle housing 462 may be used generally in nozzle 10 or nozzle 200 and simply replace the valve sleeves, nozzle housings, and restrictors illustrated for those nozzles.

Figure 16:
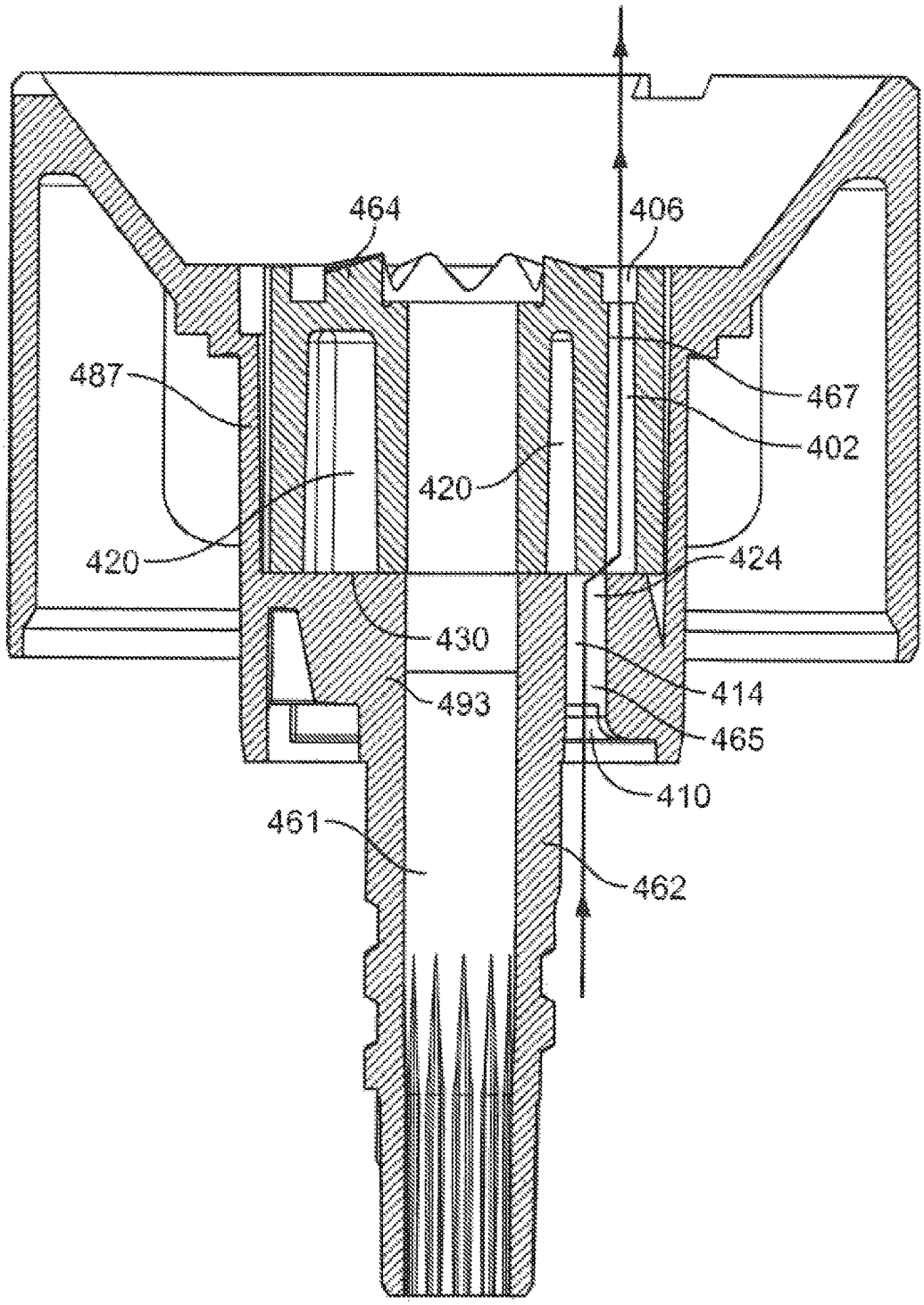
FIG. 16 is a cross-sectional view of the assembled nozzle housing and valve sleeve of FIG. 15.
Figure 17:
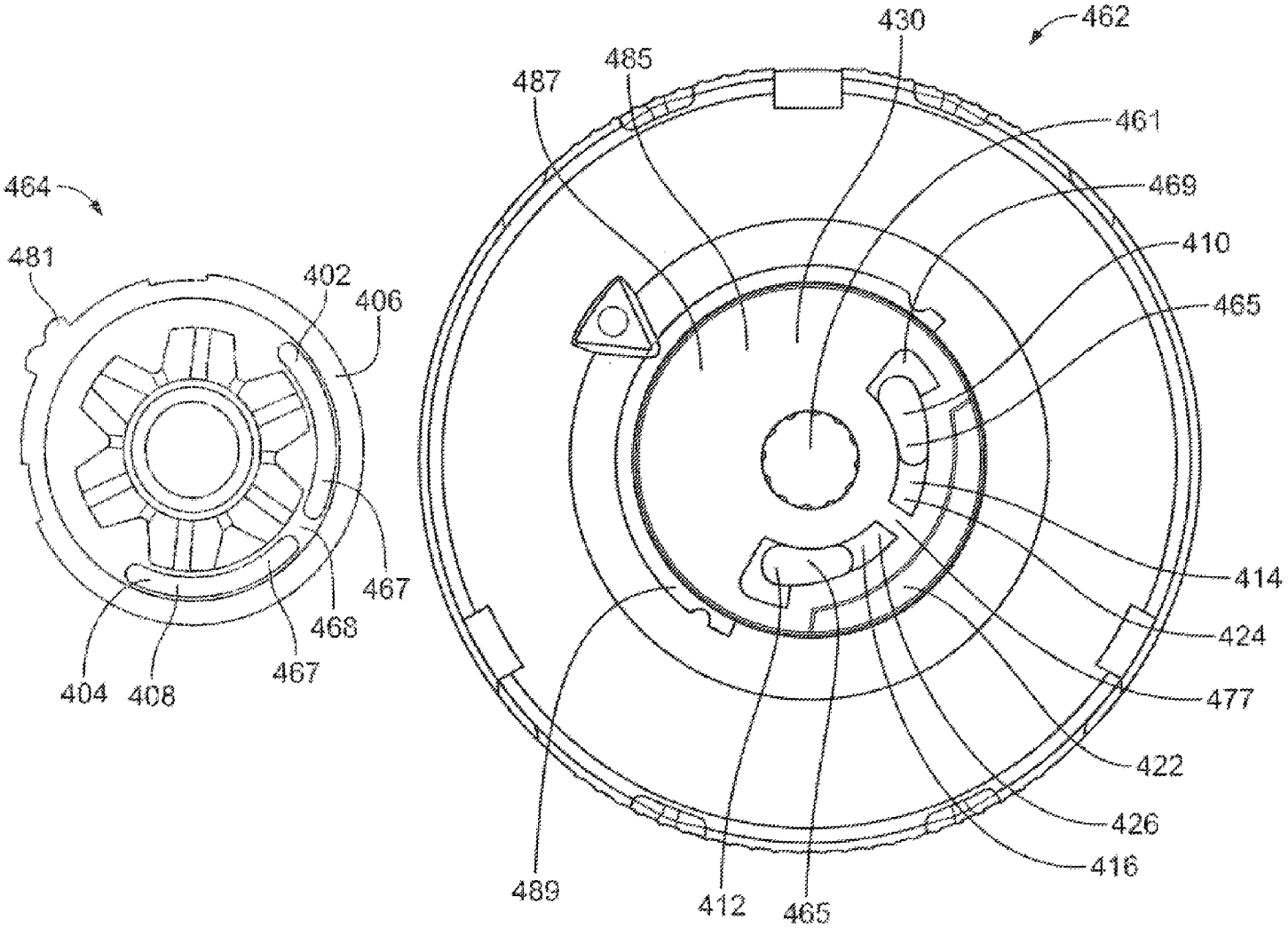
FIG. 17 is a top plan view of the unassembled nozzle housing and valve sleeve of FIG. 15.
Figure 18:
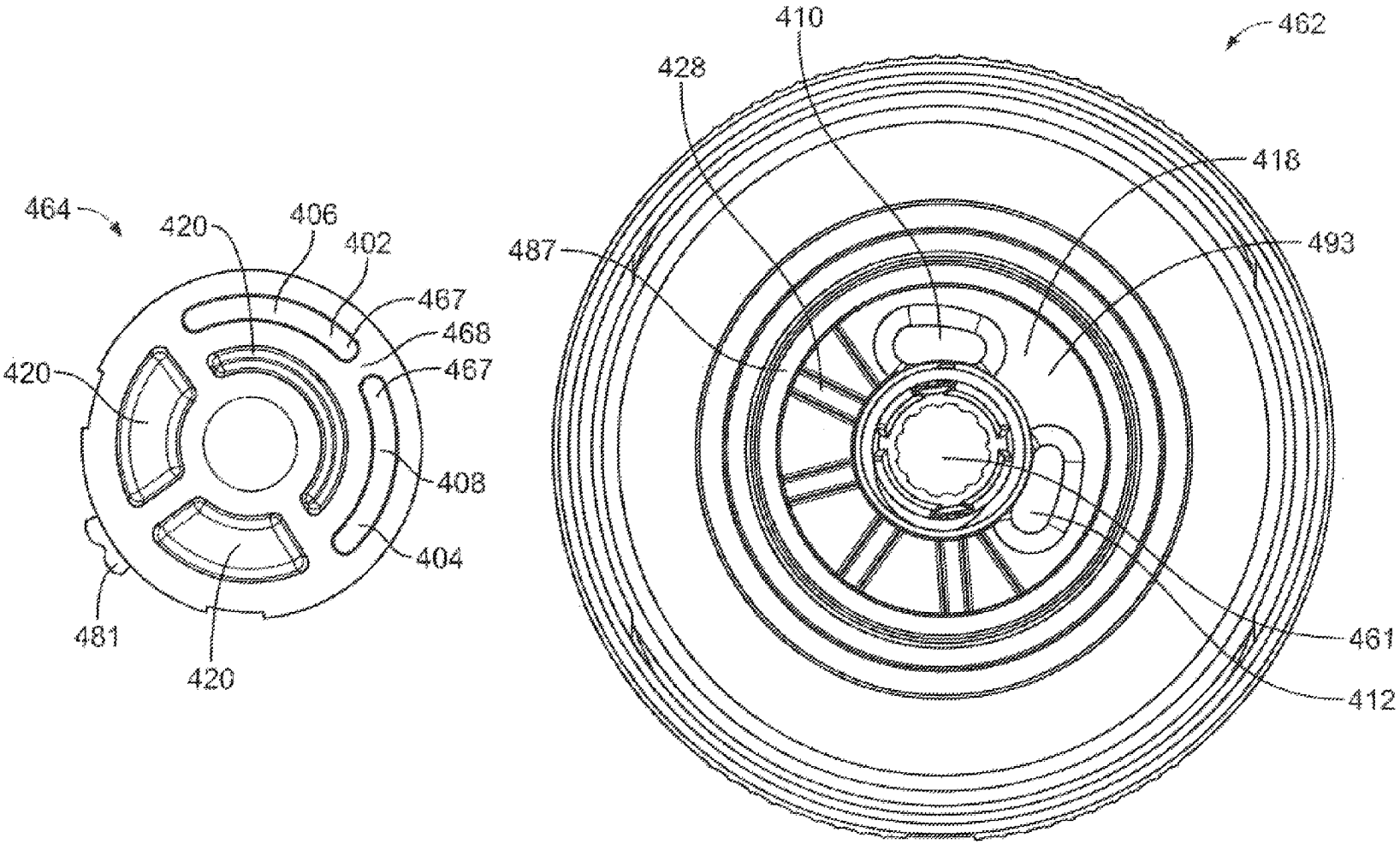
FIG. 18 is a bottom plan view of the unassembled nozzle housing and valve sleeve of FIG. 15.

As can be seen in FIGS. 15-18, the valve sleeve 464 is preferably similar to valve sleeve 264. Significantly, the arcuate slot 467 of the valve sleeve 464 again preferably has a uniform width. The arcuate slot 467 preferably has a wall 468 extending through the valve sleeve 464 that divides the valve sleeve 464 into two generally equal chambers 402 and 404 separated from one another. The top opening of the arcuate slot 467 preferably defines two separate outlets 406 and 408 from the chambers 402 and 404, and, as can be seen in FIG. 17, the edges of the outlets 406 and 408 are preferably rounded. The valve sleeve 464 may include three arcuate cavities 420 (FIG. 18), such as may result from molding the valve sleeve 465, but these cavities 420 do not extend through the entire valve body. Fluid flow only exits the valve sleeve 464 through the outlets 406 and 408 (after flowing into chambers 402 and 404). Again, valve sleeve 464 is operated to adjust the strip nozzle setting in generally the same manner as valve sleeve 264: a user depresses a deflector to engage the valve sleeve 364 via teeth and then rotates the valve sleeve 464 to the desired strip nozzle setting.

However, the structure of the nozzle housing 462 has been modified to include a unitary restrictor portion 493. More specifically, the nozzle housing 462 has two inlets 410 and 412 (in the form of apertures) allowing fluid into two separate and isolated chambers 414 and 416 with each inlet 410 and 412 dedicated to each chamber 414 and 416, respectively. In other words, fluid flowing through one of the inlets 410 and 412 may only flow through one of the chambers 414 and 416 and exit one-half of the arcuate slot 465. In this manner, as addressed further below, the precipitation rate is the same regardless of the strip nozzle setting, i.e., the precipitation rate is matched across different settings.

As can be seen from FIGS. 15-19C, the nozzle housing inlets 410 and 412 are in fluid communication with the nozzle housing chambers 414 and 416 in the central hub 487 to allow fluid to flow through the housing 462 along two separate flow paths. The inlets 410 and 412 are preferably the same shape, i.e., generally arcuate in shape with rounded edges. As shown in FIG. 17, in one form, the inlets 410 and 412 are preferably disposed in an intermediate position beneath housing chambers 414 and 416 to provide a greater flow vector to the more distant end portions of the rectangular irrigation pattern. However, as should be evident, inlets 410 and 412 may be of other shapes and may be disposed at other positions beneath housing chambers 414 and 416 to achieve a desired irrigation pattern.

Fluid flowing through inlet 410 only flows through the chamber 414 and through the half-slot opening 424, and fluid flowing through the other inlet 412 only flows through the other chamber 416 and the other half-slot opening 426. The divider wall 477 extends vertically within the central hub 487, separates the central hub 487 into the two discrete chambers 414 and 416, and prevents fluid flowing through one inlet 410 and 412 from entering the other chamber 414 and 416. As shown in FIG. 17, the nozzle housing 462 may include a cavity 422, such as may result from molding the nozzle housing 462, but this cavity 422 does not extend through the body of the nozzle housing 462. Also, the central hub 487 includes an annular plate 418 disposed beneath the arcuate slot 465 that blocks upward flow through slot 465, except through the inlets 410 and 412. The central hub 487 further preferably includes ribs 428, but the bottom surface 430 defining the cylindrical recess 485 blocks upward fluid flow between these ribs 428.

Figure 19A:
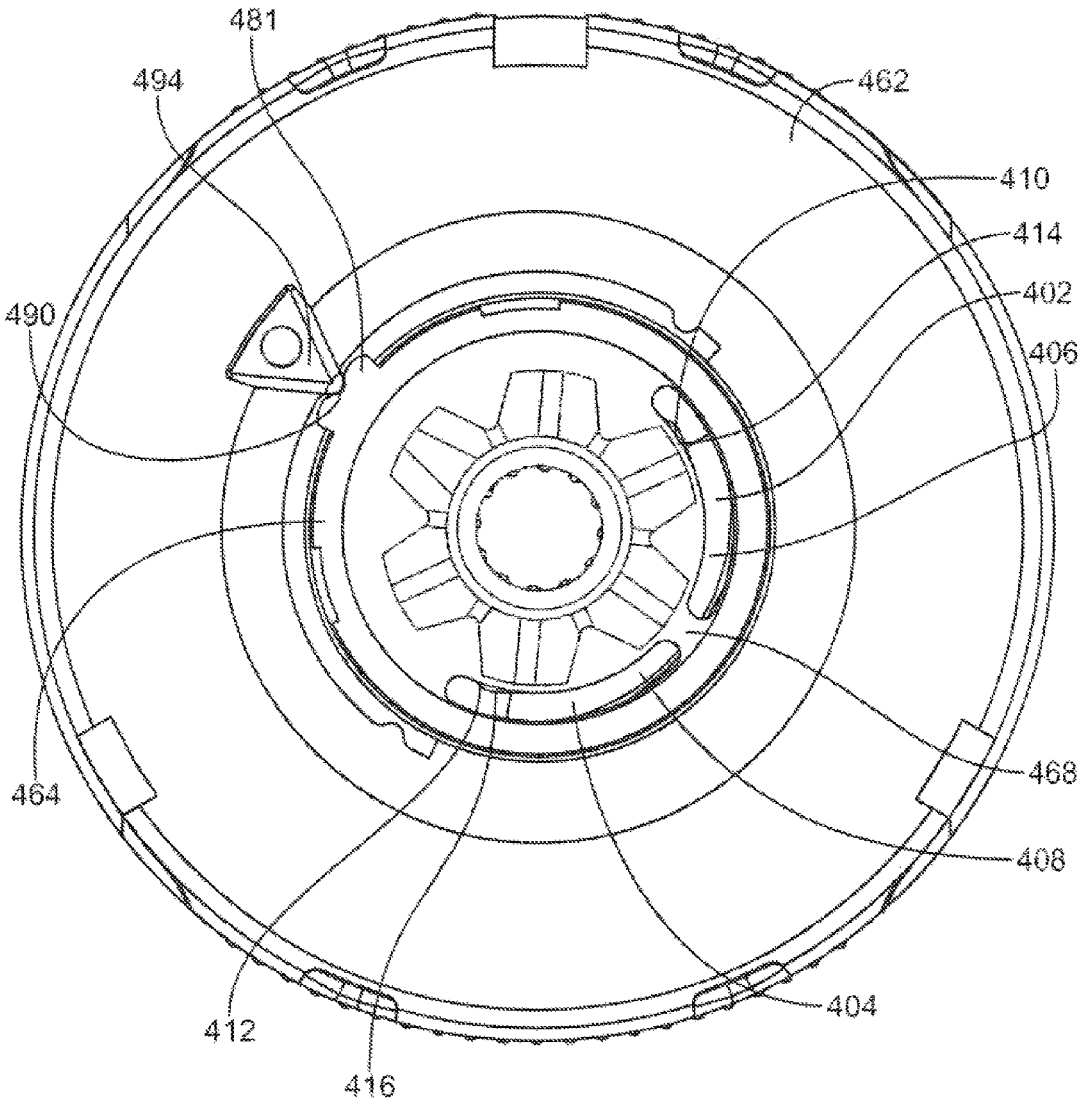
FIGS. 19A-C are top plan views of the assembled valve sleeve and nozzle housing of the nozzle of FIG. 15 in a side strip (180 degree), right strip (90 degree), and left strip (90 degree) configuration, respectively.

In other ways, the structure of the nozzle housing 462 is preferably similar to nozzle housing 262 described above. As can be seen in FIG. 17, the arcuate slot 465 is similar in shape to arcuate slot 265 and has a non-uniform width to provide right strip, left strip, and side strip irrigation. More specifically, the arcuate slot 465 preferably extends nearly 180 degrees, has two relatively wide and generally stepped flow openings, or notches, defining two channels 469 at each end, and tapers as one proceeds from the channels 469 to the dividing wall 477. The cylindrical recess 485 receives and supports the valve sleeve 464 therein. The central hub 487 defines a central bore 461 for receiving the shaft 434. Further, the nozzle housing 462 has a circumferential ledge 489 to allow the boss 481 of the valve sleeve 464 to ride therein for adjustment between predetermined settings and includes inwardly directed detents 490, 491, 492 to allow a user to rotate the valve sleeve 464 to side strip, right strip, and left strip irrigation settings, respectively. The detents are generally similar to those shown above for nozzles 10 and 200. (See FIGS. 10 and 14A-B.) In FIG. 19A, detent 490 (side strip setting) is situated beneath a triangular member 494 formed as part of a molding and manufacturing process.

As addressed in more detail below, the nozzle 40 is configured to ensure that fluid flowing into one of the nozzle housing inlets 410 and 412 exits through, at most, one of the valve sleeve outlets 406 and 408. (See, for example, flow path shown in FIG. 16.) For the side strip setting, fluid flowing through inlet 410 will exit outlet 406, and fluid flowing through inlet 412 will exit outlet 408. In the right strip setting, fluid flowing into inlet 412 will exit outlet 406 (fluid flowing into inlet 410 will be blocked and will not exit valve sleeve 464). In the left strip setting, fluid flowing into inlet 410 will exit outlet 408 (fluid flowing into inlet 412 will be blocked and will not exit valve sleeve 464).

Figure 19B:
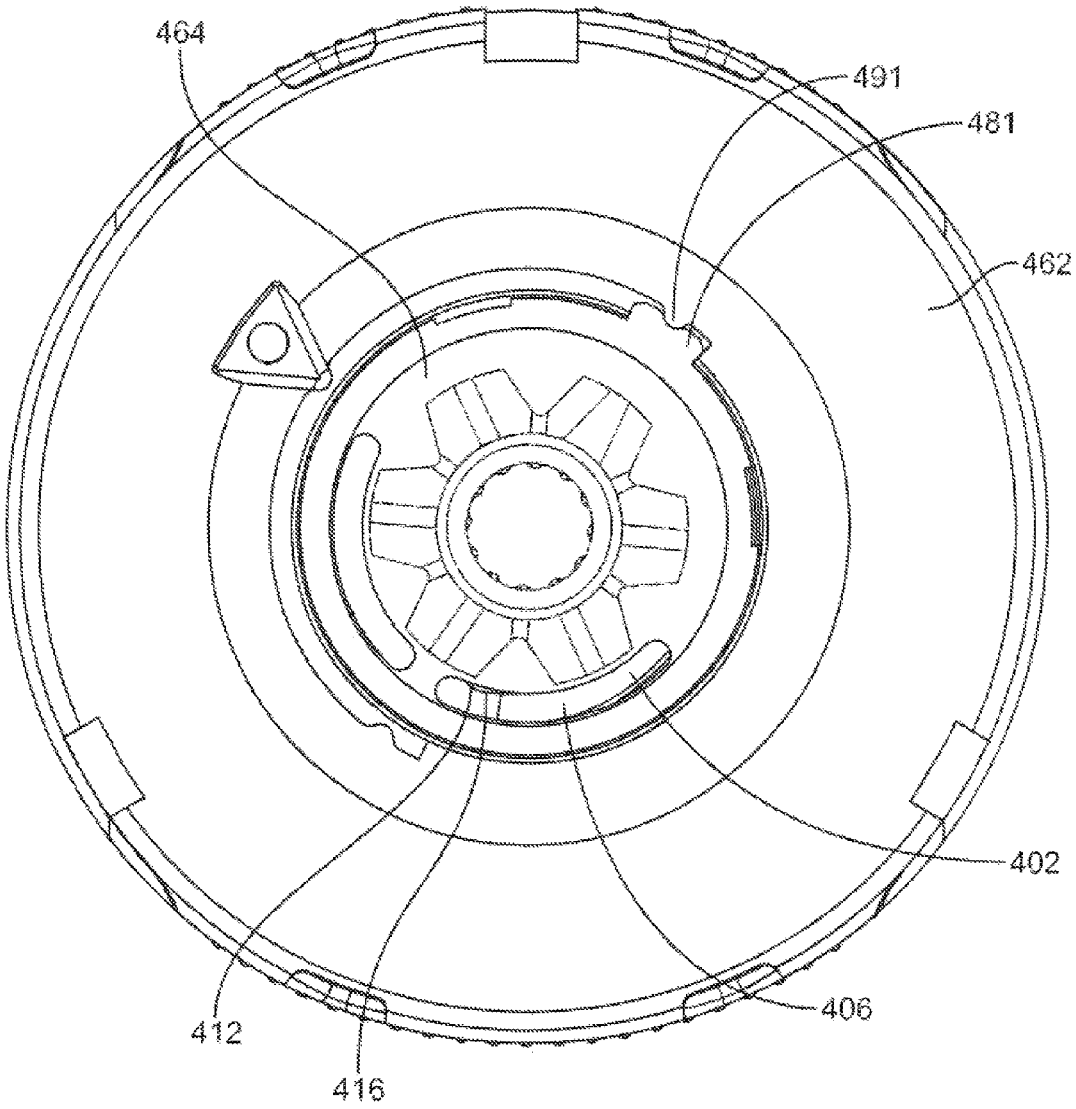
Figure 19C:
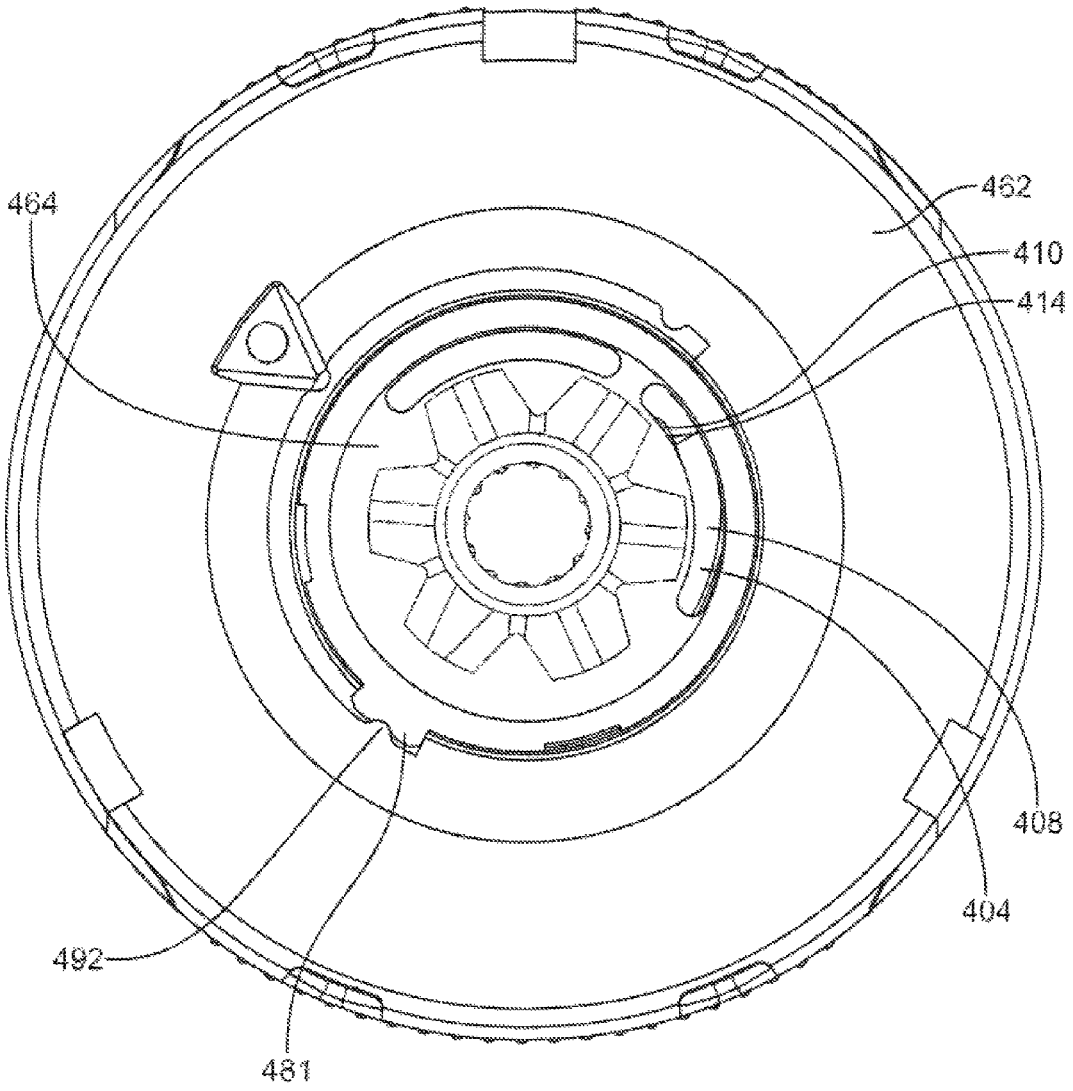

FIGS. 19A-C show a top plan view of the valve sleeve 464 and nozzle housing 462 in the three irrigation settings—side strip, right strip, and left strip settings. In the side strip setting (FIG. 19A), fluid flows through both inlets 410 and 412 and through both nozzle housing chambers 414 and 416 and valve sleeve chambers 402 and 404. More specifically, in one flow path, fluid flows through inlet 410, through nozzle housing chamber 414, through valve sleeve chamber 402, and exits valve sleeve outlet 406 (although chambers 414 and 402 are slightly offset radially from one another) (see also FIG. 16). In the other flow path, fluid flows through the other inlet 412, through the other nozzle housing chamber 416, through the other valve sleeve chamber 404, and exits the other valve sleeve outlet 408 (although chambers 416 and 404 are slightly offset radially from one another). Chambers 414 and 402 are in fluid communication with one another, while chambers 416 and 404 are in fluid communication with one another. Thus, in the side strip setting, fluid flows into both inlets 410 and 412 and exits both outlets 406 and 408 (although fluid flows along two separate and isolated flow paths).

In the right strip setting (FIG. 19B), the valve sleeve 464 has been rotated clockwise from the side strip setting. In this setting (in contrast to the side strip setting), only fluid flowing into one of the inlets 412 along one flow path exits the valve sleeve 464. In this flow path, fluid flows through inlet 412, through nozzle housing chamber 416, through the other valve sleeve chamber 402, and exits the other valve sleeve outlet 406. This can be seen in FIG. 19B, but the housing inlet 412/housing chamber 416 are slightly offset radially from the valve sleeve outlet 406/valve sleeve chamber 402. Fluid flowing into the other inlet 410 does not exit the valve sleeve 464. In this setting, the flow has been reduced in half (in contrast to the side strip setting), because only one flow path through one of the inlets 412 is open. Further, the total outlet area has been reduced in half because fluid only flows through one of the two valve sleeve outlets 406. In this manner, the precipitation rate of the right strip setting is matched to that of the side strip setting.

In the left strip setting (FIG. 19C), the valve sleeve 464 has been rotated counterclockwise from the side strip setting. Again, in this setting (in contrast to the side strip setting), only fluid flowing through one of the inlets 410 along one flow path exits the valve sleeve 464 (but this inlet 410 is different from the one for the right strip setting). More specifically, in this flow path, fluid flows through inlet 410, through nozzle housing chamber 414, through the other valve sleeve chamber 404, and exits the other valve sleeve outlet 408. Again, the flow has been reduced in half (relative to the side strip setting) such that the precipitation rate of the left strip setting has been matched to the right and side strip settings. For nozzle 400, the matched precipitation rate is preferably less than one inch per hour and is preferably about 0.6 inches per hour.

As shown in FIG. 16, in one form, the chambers of the valve sleeve 464 and the nozzle housing 462 may be offset radially from one another. More specifically, the inner and outer radiuses of arcuate slot 465 (of the nozzle housing 262) are preferably less than the corresponding inner and outer radiuses of arcuate slot 467 (of the valve sleeve 464) but with sufficient overlap to allow fluid to flow from housing chambers 414 and 416 into valve sleeve chambers 402 and 404. The radial configuration of the arcuate slots 465 and 467 may be arranged to reduce fluid flow to the shorter end of the rectangular irrigation pattern and to increase fluid flow to the longer end of the rectangular irrigation pattern.

In this nozzle 400, the restrictor portion 493 provides certain advantages. The restrictor portion 493 includes two nozzle housing inlets 410 and 412 to reduce fluid flow through the housing 462. Further, these inlets 410 and 412 are arranged in a one-to-one correspondence with one or both of the valve sleeve outlets 406 and 408 in order to maintain proportionality in all strip nozzle settings. A further advantage of nozzle 400 is that the restrictor portion 493 is molded as part of the housing, rather than as a separate part, reducing complexity and cost.

As shown in FIG. 2, the nozzle 10 also preferably includes a radius control valve 125. The radius control valve 125 can be used to selectively set the water radius through the nozzle 10, for purposes of regulating the range of throw of the projected water streams. It is adapted for variable setting through use of a rotatable segment 124 located on an outer wall portion of the nozzle 10. It functions as a second valve that can be opened or closed to allow the flow of water through the nozzle 10. Also, a filter 126 is preferably located upstream of the radius control valve 125, so that it obstructs passage of sizable particulate and other debris that could otherwise damage the nozzle components or compromise desired efficacy of the nozzle 10. Although the radius control valve 125 and other structure is discussed with respect to nozzle 10 (FIG. 2), this discussion applies equally to nozzle 200 (FIG. 9).

The radius control valve 125 allows the user to set the relative dimensions of the side, left, and right rectangular strips. In one preferred form, the nozzle 10 irrigates a 5 foot by 30 foot side strip area and a 5 foot by 15 foot left and right strip area, when the radius control valve 14 is fully open. The user may then adjust the valve 14 to reduce the throw radius, which decreases the size of the rectangular area being irrigated but maintains the proportionate sizes of the legs of the rectangle.

As shown in FIGS. 2-4, the radius control valve structure preferably includes a nozzle collar 128 and a flow control member 130. The nozzle collar 128 is rotatable about the central axis C-C of the nozzle 10. It has an internal engagement surface 132 and engages the flow control member 130 so that rotation of the nozzle collar 128 results in rotation of the flow control member 130. The flow control member 130 also engages the nozzle housing 62 such that rotation of the flow control member 130 causes it to move in an axial direction, as described further below. In this manner, rotation of the nozzle collar 128 can be used to move the flow control member 130 axially closer to and further away from an inlet 134. When the flow control member 130 is moved closer to the inlet 134, the throw radius is reduced. The axial movement of the flow control member 130 towards the inlet 134 increasingly pinches the flow through the inlet 134. When the flow control member 130 is moved further away from the inlet 134, the throw radius is increased. This axial movement allows the user to adjust the effective throw rqadius of the nozzle 10 without disruption of the streams dispersed by the deflector 22.

As shown in FIGS. 2-4, the nozzle collar 128 is preferably cylindrical in shape and includes an engagement surface 132, preferably a splined surface, on the interior of the cylinder. The nozzle collar 128 preferably also includes an outer wall 124 having an external grooved surface for gripping and rotation by a user. Water flowing through the inlet 134 passes through the interior of the cylinder and through the remainder of the nozzle body 16 to the deflector 22. Rotation of the outer wall 124 causes rotation of the entire nozzle collar 128.

The nozzle collar 128 is coupled to the flow control member 130 (or throttle body). As shown in FIGS. 3-4, the flow control member 130 is preferably in the form of a ring-shaped nut with a central hub defining a central bore 152. The flow control member 130 has an external surface with two thin tabs 151 extending radially outward for engagement with the corresponding internal splined surface 132 of the nozzle collar 128. The tabs 151 and internal splined surface 132 interlock such that rotation of the nozzle collar 128 causes rotation of the flow control member 130 about central axis C-C. Although certain engagement surfaces are shown in the preferred embodiment, it should be evident that other engagement surfaces, such as threaded surfaces, could be used to cause the simultaneous rotation of the nozzle collar 128 and flow control member 130.

In turn, the flow control member 130 is coupled to the nozzle housing 62. More specifically, the flow control member 130 is internally threaded for engagement with an externally threaded hollow post 158 at the lower end of the nozzle housing 62. Rotation of the flow control member 130 causes it to move along the threading in an axial direction. In one preferred form, rotation of the flow control member 130 in a counterclockwise direction advances the member 130 towards the inlet 134 and away from the deflector 22. Conversely, rotation of the flow control member 130 in a clockwise direction causes the member 130 to move away from the inlet 134. Although threaded surfaces are shown in the preferred embodiment, it is contemplated that other engagement surfaces could be used to effect axial movement.

The nozzle housing 62 preferably includes an outer cylindrical wall 160 joined by spoke-like ribs 162 to an inner cylindrical wall 164. The inner cylindrical wall 164 preferably defines the bore 61 to accommodate insertion of the shaft 34 therein. The inside of the bore 61 is preferably splined to engage a splined surface 35 of the shaft 34 and fix the shaft against rotation. The lower end forms the external threaded hollow post 158 for insertion in the bore 152 of the flow control member 130 as discussed above. The ribs 162 define flow passages 168 to allow fluid flow upwardly through the remainder of the nozzle 10.

In operation, a user may rotate the outer wall 140 of the nozzle collar 128 in a clockwise or counterclockwise direction. As shown in FIGS. 3 and 4, the nozzle housing 62 preferably includes one or more cut-out portions 63 to define one or more access windows to allow rotation of the nozzle collar outer wall 140. Further, as shown in FIG. 2, the nozzle collar 128, flow control member 130, and nozzle housing 62 are oriented and spaced to allow the flow control member 130 to essentially block fluid flow through the inlet 134 or to allow a desired amount of fluid flow through the inlet 134. The flow control member 130 preferably has a helical bottom surface 170 for engagement with a valve seat 172 (preferably having a helical top surface).

Rotation in a counterclockwise direction results in axial movement of the flow control member 130 toward the inlet 134. Continued rotation results in the flow control member 130 advancing to the valve seat 172 formed at the inlet 134 for blocking fluid flow. The dimensions of the radial tabs 151 of the flow control member 130 and the splined internal surface 132 of the nozzle collar 128 are preferably selected to provide over-rotation protection. More specifically, the radial tabs 151 are sufficiently flexible such that they slip out of the splined recesses upon over-rotation. Once the inlet 134 is blocked, further rotation of the nozzle collar 128 causes slippage of the radial tabs 151, allowing the collar 128 to continue to rotate without corresponding rotation of the flow control member 130, which might otherwise cause potential damage to nozzle components.

Rotation in a clockwise direction causes the flow control member 130 to move axially away from the inlet 134. Continued rotation allows an increasing amount of fluid flow through the inlet 134, and the nozzle collar 128 may be rotated to the desired amount of fluid flow. When the valve is open, fluid flows through the nozzle 10 along the following flow path: through the inlet 134, between the nozzle collar 128 and the flow control member 130, through the flow passages 168 of the nozzle housing 62, through the arcuate opening 20, to the underside surface of the deflector 22, and radially outwardly from the deflector 22. At a very low arcuate setting, water flowing through the opening 20 may not be adequate to impart sufficient force for desired rotation of the deflector 22, so in these embodiments, the minimum arcuate setting has been set to 45 and 90 degrees. It should be evident that other minimum and maximum arcuate settings may be designed, as desired. It should also be evident that the direction of rotation of the outer wall 140 for axial movement of the flow control member 130 can be easily reversed, i.e., from clockwise to counterclockwise or vice versa.

The nozzle 10 illustrated in FIGS. 2-4 also preferably includes a nozzle base 174 of generally cylindrical shape with internal threading 176 for quick and easy thread-on mounting onto a threaded upper end of a riser with complementary threading (not shown). The nozzle base 174 and nozzle housing 62 are preferably attached to one another by welding, snap-fit, or other fastening method such that the nozzle housing 62 is relatively stationary when the base 174 is threadedly mounted to a riser. The nozzle 10 also preferably includes seal members 184, such as o-rings, at various positions, as shown in FIG. 2, to reduce leakage. The nozzle 10 also preferably includes retaining rings or washers 188 disposed near the bottom end of the shaft 134 for retaining the spring 186.

The radius adjustment valve 125 and certain other components described herein are preferably similar to that described in U.S. patent application Ser. Nos. 12/952,369 and 13/495,402, which are assigned to the assignee of the present application and are incorporated herein by reference in their entirety. Generally, in this preferred form, the user rotates a nozzle collar 128 to cause a throttle nut 130 to move axially toward and away from the valve seat 172 to adjust the throw radius. Although this type of radius adjustment valve 125 is described herein, it is contemplated that other types of radius adjustment valves may also be used.

It will be understood that various changes in the details, materials, and arrangements of parts and components which have been herein described and illustrated in order to explain the nature of the nozzle may be made by those skilled in the art within the principle and scope of the nozzle and the flow control device as expressed in the appended claims. Furthermore, while various features have been described with regard to a particular embodiment or a particular approach, it will be appreciated that features described for one embodiment also may be incorporated with the other described embodiments.

What is claimed is:

1. A nozzle comprising:

a deflector having an upstream surface contoured to deliver fluid radially outwardly therefrom through a coverage area;

a pattern adjustment valve defining an opening adjustable in size to set the coverage area and comprising a first valve body and a second valve body, the valve bodies shiftable relative to one another to increase or decrease the size of the valve opening;

wherein the two valve bodies cooperate to adjust the size of the opening to a first valve setting to define a first substantially rectangular irrigation coverage area;

wherein the two valve bodies cooperate to adjust the size of the opening to a second valve setting to define a second, different substantially rectangular irrigation coverage area; and a restrictor that reduces flow through the pattern adjustment valve, the restrictor comprising:

a first flow restricting aperture in fluid communication with a first chamber of the second valve body, the first chamber having a larger cross-section than the first flow restricting aperture; and a second flow restricting aperture in fluid communication with a second chamber of the second valve body, the second chamber having a larger cross-section than the second flow restricting aperture;

wherein the first valve body includes a first outlet and a second outlet and the second valve body includes the restrictor such that in the second valve setting, the first flow restricting aperture is in fluid communication with the first outlet to define a first, isolated flow path and wherein the second flow restricting aperture is in fluid communication with the second outlet to define a second, isolated flow path, and in the first valve setting, the first flow restricting aperture is in fluid communication with the second outlet to define a third, isolated flow path and wherein the second flow restricting aperture is not in fluid communication with the first or second outlets.

2. The nozzle of claim 1 wherein the first and second chambers are separated from one another by a first dividing wall.

3. The nozzle of claim 2 wherein the first valve body comprises a third chamber in fluid communication with the first outlet and a fourth chamber in fluid communication with the second outlet, the third and fourth chambers separated from one another by a second dividing wall.

4. The nozzle of claim 3 wherein one of the first and second chambers is in fluid communication with one of the third and fourth chambers to define a single flow path through the two valve bodies when the two valve bodies are in the first valve setting.

5. The nozzle of claim 4 wherein the first chamber is in fluid communication with the third chamber and the second chamber is in fluid communication with the fourth chamber to define two flow paths through the two valve bodies when the two valve bodies are in the second different valve setting.

6. The nozzle of claim 5 wherein the first and second chambers are offset radially relative to the third and fourth chambers.

7. The nozzle of claim 1 wherein a precipitation rate of fluid through the nozzle is less than or equal to 1 inch per hour.

8. The nozzle of claim 1 wherein the two valve bodies cooperate to adjust the size of the opening to a third valve setting to define a third substantially rectangular irrigation area that is different than the other two substantially rectangular irrigation areas.

9. The nozzle of claim 1 wherein each valve body comprises an arcuate slot shiftable relative to the other arcuate slot to increase or decrease the size of the valve opening.

10. The nozzle of claim 9 wherein the arcuate slot of one of the valve bodies has a non-uniform width.

11. The nozzle of claim 9 wherein the arcuate slot of one of the valve bodies has at least one enlarged end.

12. The nozzle of claim 9 wherein the arcuate slot of one of the valve bodies has a tapered portion.

13. The nozzle of claim 9 wherein the slots are aligned to set a maximum arcuate span of generally 180 degrees and are staggered to set an arcuate span of generally 90 degrees.

14. The nozzle of claim 9 wherein the arcuate slot of the first valve body comprises a notch at each end of the slot defining a channel and wherein the slot comprises a tapering portion as one proceeds from each end to the middle of the slot.

15. The nozzle of claim 1 wherein:

the deflector is moveable between an operational position and an adjustment position; and the deflector engages the first valve body for setting the size of the opening in the adjustment position and wherein the deflector disengages from the first valve body for irrigation in the operational position.

16. A method of irrigation using a nozzle comprising:

a deflector with an upstream surface contoured to deliver fluid radially outwardly therefrom through a coverage area and a pattern adjustment valve defining an opening adjustable in size to set the coverage area, the valve comprising a first valve body and a second valve body, the valve bodies shiftable relative to one another to increase or decrease the size of the valve opening;

wherein the two valve bodies cooperate to adjust the size of the opening to a first valve setting to define a first substantially rectangular irrigation coverage area;

wherein the two valve bodies cooperate to adjust the size of the opening to a second valve setting to define a second, different substantially rectangular irrigation coverage area; and a restrictor that reduces flow through the pattern adjustment valve, the restrictor comprising:

a first flow restricting aperture in fluid communication with a first chamber of the second valve body, the first chamber having a larger cross-section than the first flow restricting aperture; and a second flow restricting aperture in fluid communication with a second chamber of the second valve body, the second chamber having a larger cross-section than the second flow restricting aperture;

wherein the first valve body includes a first outlet and a second outlet and the second valve body includes the restrictor such that in the second valve setting, the first flow restricting aperture is in fluid communication with the first outlet to define a first, isolated flow path and wherein the second flow restricting aperture is in fluid communication with the second outlet to define a second, isolated flow path, and in the first valve setting, the first flow restricting aperture is in fluid communication with the second outlet to define a third, isolated flow path and wherein the second flow restricting aperture is not in fluid communication with the first or second outlets; the method comprising:

moving the first valve body to a first valve setting to define a first substantially rectangular irrigation area; and moving the first valve body to a second valve setting to define a second, larger substantially rectangular irrigation area.

17. The method of claim 16, the second valve body defining a first inlet and a second inlet, the method further comprising:

directing fluid along a first flow path from one of the first and second inlets and through one of the first and second outlets in the first valve setting; and directing fluid along a second flow path from one inlet and through one outlet and along a third flow path from the other inlet through the other outlet in the second valve setting.

18. The method of the claim 16 further comprising moving the first valve body to a third valve setting to define a third substantially rectangular irrigation area that is different than the other two substantially rectangular irrigation areas.

19. The method of claim 16 further comprising:

moving the deflector into engagement with the first valve body; and rotating the deflector to effect rotation of the first valve body to set the size of the valve opening.

20. The nozzle of claim 1 wherein the restrictor is a unitary portion of the second valve body and is disposed upstream of the first valve body.

21. The nozzle of claim 13 wherein the arcuate slot of at least one of the first and second valve bodies is an interrupted arcuate slot comprising two arcuate sub-slots separated by a divider.

* * * * *

UNITED STATES PATENT AND TRADEMARK OFFICE

CERTIFICATE OF CORRECTION

PATENT NO. : 9,327,297 B2
APPLICATION NO. : 13/828582
DATED : May 3, 2016
INVENTOR(S) : Samuel C. Walker It is certified that error appears in the above-identified patent and that said Letters Patent is hereby corrected as shown below:

TITLE PAGE

Item (57) Abstract, line 1, delete "adjusment" and insert --adjustment-- therefor.

Signed and Sealed this
Nineteenth Day of July, 2016

Michelle K. Lee

Michelle K. Lee
*Director of the United States Patent and Trademark Office*